US007189134B2

(12) United States Patent
Nugent et al.

(10) Patent No.: US 7,189,134 B2
(45) Date of Patent: Mar. 13, 2007

(54) INTERACTIVE BEVERAGE BOTTLE TOP

(75) Inventors: Timothy James Nugent, Smyrna, GA (US); Leon James Scott, III, Atlanta, GA (US)

(73) Assignee: In Zone, Inc., Austell, GA (US)

( * ) Notice: Subject to any disclaimer, the term of this patent is extended or adjusted under 35 U.S.C. 154(b) by 344 days.

(21) Appl. No.: 10/426,074

(22) Filed: Apr. 29, 2003

(65) Prior Publication Data

US 2004/0116036 A1 Jun. 17, 2004

Related U.S. Application Data

(60) Provisional application No. 60/427,322, filed on Nov. 18, 2002.

(51) Int. Cl.

| | |
|---|---|
| ***A63H 3/00*** | (2006.01) |
| ***A63H 33/00*** | (2006.01) |
| ***B65D 41/00*** | (2006.01) |
| ***B67D 5/32*** | (2006.01) |

(52) U.S. Cl. ..... 446/74; 446/71; 215/230; 222/39

(58) Field of Classification Search ..... 446/71, 446/74, 404, 408, 397; 206/217, 457, 459.1; 215/227, 228, 230, 388, 389, 11.5; 220/212, 220/705; 222/39, 113; 340/384.7, 691.1, 340/693.5, 691.2, 384.3; 116/264, 266, 268, 116/137 R; 214/229

See application file for complete search history.

(56) References Cited

U.S. PATENT DOCUMENTS

| | | | | |
|---|---|---|---|---|
| 3,061,202 | A * | 10/1962 | Tyler | 222/341 |
| 4,583,651 | A | 4/1986 | Ostberg | 215/228 |
| 4,678,093 | A | 7/1987 | Allen | 215/11 |
| 4,736,871 | A * | 4/1988 | Luciani et al. | 222/25 |
| 4,801,929 | A * | 1/1989 | Instance | 215/201 |

(Continued)

FOREIGN PATENT DOCUMENTS

| | | | |
|---|---|---|---|
| FR | 2767118 | A1 * | 2/1999 |

(Continued)

OTHER PUBLICATIONS

Belly Washers Collection obtained from http://www.bellywashers.com/collector2.html, dated Aug. 1, 2003, 26 pages.

*Primary Examiner*—Eugene Kim
*Assistant Examiner*—Urszula M Cegielnik
(74) *Attorney, Agent, or Firm*—Wong, Cabello, Lutsch, Rutherford & Brucculeri LLP

(57) ABSTRACT

Beverage bottle tops having interactive elements or performing interactive actions are disclosed. The beverage bottle tops are capable of conveying liquid from the bottle to a person. The beverage bottle tops include interactive elements, structures, or acts, which result from activation thereof. For example, the interactive elements, structures, or acts include, but are not limited to, members moving on the bottle top, lights illuminating on the bottle top, sounds emanating from the bottle top, or squirting liquid from the bottle top. The interactive bottle tops can be activated manually, electrically, or magnetically. In addition, the interactive bottle tops can be activated by squeezing a body on the bottle top, by operating a trigger on the bottle top, by changes in environmental light or sound, or by drinking liquid through the bottle top.

9 Claims, 21 Drawing Sheets

U.S. PATENT DOCUMENTS

| | | | | |
|---|---|---|---|---|
| D310,781 | S | 9/1990 | Scott, III | D9/398 |
| 5,310,068 | A | 5/1994 | Saghri | 215/100 |
| 5,625,347 | A * | 4/1997 | MacLean et al. | 206/539 |
| 5,897,027 | A * | 4/1999 | Steiner et al. | 222/78 |
| 5,939,983 | A * | 8/1999 | Rudell et al. | 446/404 |
| 6,158,870 | A | 12/2000 | Ramirez | 362/101 |
| 6,237,787 | B1 | 5/2001 | Gallo et al. | 215/12.1 |
| 6,488,556 | B2 | 12/2002 | Galomb | 446/73 |
| 6,545,594 | B1 * | 4/2003 | Knight et al. | 206/217 |
| 6,771,165 | B2 * | 8/2004 | Burg II et al. | 340/384.1 |
| 2001/0042754 | A1 * | 11/2001 | Lei | 220/705 |
| 2001/0050289 | A1 * | 12/2001 | Cordes | 222/39 |
| 2003/0189494 | A1 * | 10/2003 | Lin | 215/230 |

FOREIGN PATENT DOCUMENTS

| | | | | |
|---|---|---|---|---|
| FR | 2782984 | A1 * | 3/2000 |
| GB | 2318522 | A * | 4/1998 |
| JP | 2003210866 | A * | 7/2003 |
| JP | 2003334388 | A * | 11/2003 |
| JP | 2003339492 | A * | 12/2003 |
| WO | WO 94/17691 | A2 * | 8/1994 |
| WO | WO 98/21112 | A1 * | 5/1998 |
| WO | WO 200276855 | A1 * | 10/2002 |
| WO | WO 2003022700 | A1 * | 3/2003 |

* cited by examiner

INTERACTIVE BEVERAGE BOTTLE TOP

CROSS-REFERENCE TO RELATED APPLICATIONS

This application claims the benefit of U.S. Provisional Application Ser. No. 60/427,322, filed Nov. 18, 2002, which is incorporated herein by reference in its entirety.

FIELD OF THE INVENTION

The present invention relates generally to a beverage bottle top and, more particularly to, a beverage bottle top having interactive elements or structures operable to perform interactive actions.

BACKGROUND OF THE INVENTION

Decorative bottle tops exist in the art. Referring to FIG. 1, a decorative bottle top according to the prior art is illustrated. The bottle top includes a forecap or stem 10, a cap 12, a spout 14, and a decorative body 20. The cap 12 attaches to a beverage bottle 18. Typically, the cap 12 threads onto the bottle 18 so that the bottle 18 and cap 12 can be cleaned and reused. The stem 10 extends from the cap 12 and has retaining members 11 adjacent the cap 12.

The stem 10 defines an internal annulus (not shown), which conveys liquid from the bottle 18 to the spout 14. The spout 14 is movably attached to an end 16 of the stem 10 and can be moved thereon to permit or restrict the liquid from leaving the end 16. The stem 10 includes four, angled keys or tabs 11.

The decorative body 20 is schematically illustrated in cross-section in FIG. 1. The decorative body 20 can be a figurine, for example. The decorative body 20 defines a passage or hollow 21 having a first opening 22 and a second opening 24. The decorative body 20 fixedly attaches to the cap 12 and stem 10 by inserting the stem 10 through the first opening 22 of the body 20. The retaining members 11 engage the opening 22 to hold the body 20 on the stem 10 and cap 12. The spout 14 extends beyond the second opening 24, enabling a person to access the spout 14 for drinking.

Bottle tops having a fixed, decorative body such as that discussed above provide an effective way to enhance a beverage bottle. However, manufacturers are continually striving to improve or enhance products. The present invention is directed to interactive bottle tops that further enhance a beverage bottle.

SUMMARY OF THE PRESENT DISCLOSURE

An interactive top for a beverage bottle is disclosed having a cap for attaching to the bottle and having a stem for drinking. The interactive top also includes an interactive device positioned on the top and operable to perform an interactive action. The interactive action can be a mechanical, an electrical, and an electromechanical action. For example, the interactive actions can include, but are not limited to, members moving on the bottle top, lights illuminating on the bottle top, sounds emanating from the bottle top, or liquid squirting from the bottle top. The interactive bottle tops can be operated manually, electrically, or magnetically. In addition, the interactive bottle tops can be operated by squeezing a body on the bottle top, by operating a trigger on the bottle top, by changes in environmental light or sound, or by drinking liquid through the bottle top.

In one embodiment, an interactive top includes an operating device at least partially positioned in an internal bore of the stem and operating the interactive device when the beverage is passed through the internal bore. In one embodiment of the operating device, the operating device can include electrical contacts coupled to the interactive device and creating a closed circuit when beverage is passed through the internal bore. In an alternative embodiment, the operating device can include a rotor coupled to the interactive device and rotated by the beverage passed through the internal bore.

In another embodiment, an interactive top includes a body on the stem. An interactive device is attached to the body and is operable to perform an interactive action. The interactive device can include an electric motor, a mechanical motor, a wind-up motor, a speaker, a light, a battery, or a circuit. A switch, a button, a knob, a flywheel, a rotor, a zip strip, a light sensor, a sound sensor, a magnetic sensor, or a motion sensor can activate the interactive device.

In another embodiment, an interactive top includes a removable body positioning on the stem such that a distal end of the stem extends from the body. A retaining member is disposed on the top, and a locking member is disposed on the body. The locking member is engageable with the retaining member for removing or retaining the body on the top. The locking member can include an internal shoulder within the body, a movable ring, or a deformable ring. The retaining member can include an external shoulder formed on the stem.

In another embodiment, an interactive top includes a body movably positioned on the stem. A biasing member has a first end attached to the body and has a second end attached to the top. The biasing member can be a spring or a substantially tubular body having a plurality of flexible folds. The body can be movable along a length of the stem or can be rotatable about the stem.

In another embodiment, an interactive top includes a first body positioned on the stem and includes a second body positioned on the stem such that a distal end of the stem extends therefrom. The first and second bodies are rotatably coupled together such that at least one of the bodies is rotatable about the stem.

In another embodiment, an interactive top includes a body positioned on the stem, and includes an articulating member movably coupled to the body. An operating device is coupled to the articulating member and moves the articulating member when activated. The operating device can include a mechanical motor, a wind-up motor, a pullback motor, a linkage, a gear, a biasing member, a flywheel, a rotor, or an impeller and can be activated by a button, a lever, a switch, a knob, a wheel, or a zip strip. Alternatively, the operating device can includes an electric motor housed in the body and activated by a button, a switch, a timer, a circuit, a light sensor, a sound sensor, or a magnetic sensor.

In another embodiment, an interactive top includes an attachment ring is positioned on the stem and is rotatable thereon. A body is attached to the attachment ring for spinning about the stem.

In another embodiment, an interactive top includes an inner body positioned on the stem such that the distal end of the stem extends therefrom. An outer body has at least two portions that are connectable together. The outer body positions on the stem to conceal the inner body.

In another embodiment, an interactive top includes a body positioned on the top. The body defines a first open area for sliding on a string.

In another embodiment, an interactive top includes a spout movably coupled to a distal end of a stem. The spout controls the beverage from the stem. A body is coupled to the spout for opening and closing the spout. The body defines an internal passage for passing the beverage from the spout to an outlet of the body.

In another embodiment, an interactive top includes a body positioned on the stem. The body defines a deformable cavity. The cavity has an inlet and an outlet. The inlet receives beverage from the stem, and the outlet conveys the beverage from the deformable cavity when the body is squeezed.

In another embodiment, an interactive top includes a body positioned on the stem and includes a pump on the body. The pump has an inlet and an outlet. The inlet is connected to a distal end of a stem. A trigger is coupled to the pump and activates the pump to squirt beverage from the outlet.

The foregoing summary is not intended to summarize each potential embodiment or every aspect of the interactive beverage bottle tops of the present disclosure.

BRIEF DESCRIPTION OF THE DRAWINGS

The foregoing summary, preferred embodiments, and other aspects of the subject matter of the present disclosure will be best understood with reference to a detailed description of specific embodiments, which follows, when read in conjunction with the accompanying drawings, in which:

FIGS. 14–15C illustrate embodiments of interactive bottle tops having manually movable members according to certain teachings of the present disclosure.

Figure 1:
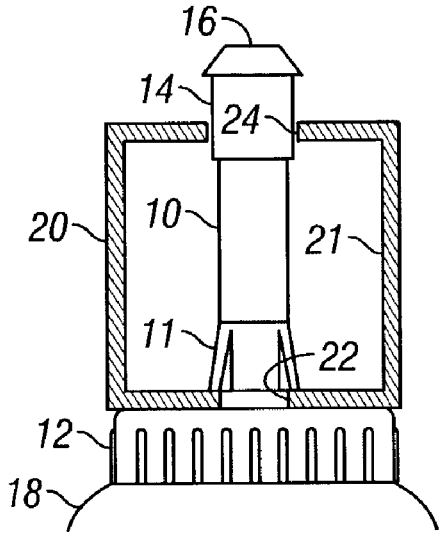
FIG. 1 (Prior Art)
FIG. 1 illustrates a bottle top according to the prior art.

While the disclosed interactive beverage bottle tops are susceptible to various modifications and alternative forms, specific embodiments thereof have been shown by way of example in the drawings and are herein described in detail. The figures and written description are not intended to limit the scope of the inventive concepts disclosed herein in any manner. Rather, the figures and written description are provided to illustrate the inventive concepts to a person of ordinary skill in the art by reference to particular embodiments, as required by 35 U.S.C. § 112.

DETAILED DESCRIPTION

Figure 2A:
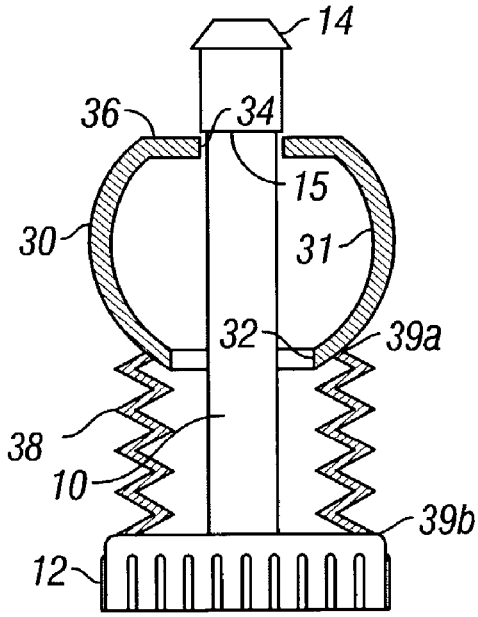
FIGS. 2A–C illustrate various views of embodiments of an interactive bottle top having a biased body according to certain teachings of the present disclosure.
Figure 2B:
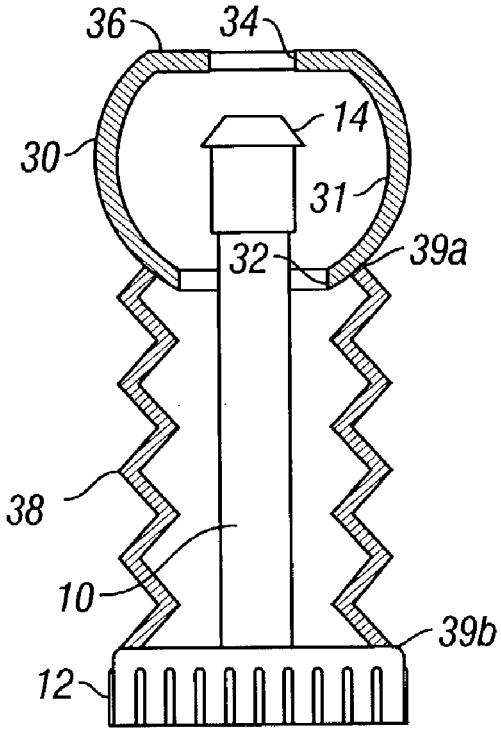

Referring to FIGS. 2A–B, an embodiment of an interactive bottle top having a movable body 30 is illustrated. It is understood that this and other embodiments of interactive bottle tops illustrated herein are depicted in a basic form to show the gross anatomy of the present invention more clearly. The interactive bottle top includes a movable body portion 30 for performing an interactive action and includes a flexible or extending portion 38 for operating the interactive action. The body portion 30 defines a passage or hollow 31 having a bottom opening 32 and a top opening 34 for the forecap or stem 10 and spout 14. For example, the body portion 30 can be a hollow head of a cartoon character or the like. The body portion 30 can be composed of polyvinyl chloride (PVC), acrylonitrile-butadiene-styrene (ABS), or other suitable material.

The flexible portion 38 is disposed about the stem 10 and is attached to the body portion 30 at one end 39*a* and attached to the cap 30 at another end 39*b*. The flexible portion 38 acts as a biasing member and has a tubular shape with accordion folds formed therein. The flexible portion 38 can also be composed of polyvinyl chloride (PVC), acrylonitrile-butadiene-styrene (ABS), or other suitable material. One skilled in the art will recognize that the body portion 30 and the flexible portion 38 can be separately formed and attached together by methods known in the art, such as gluing with a PVC welding cement at 39*a*, 39*b*.

In use, the body portion 30 can be moved away from the cap 12 to hide the spout 14 and enable the bottle top to be used for active play. The flexible portion 38 enables the body portion 30 to pop-up, such as shown in FIG. 2B. In use, the body portion 30 can also be moved adjacent the cap 12 to gain access to the spout 14 for drinking liquid, such as shown in FIG. 2A. In one embodiment of the disclosed top 10, the body portion 30 can be held adjacent the cap 12 by the mouth of the person drinking from the spout 14. Alternatively, the bottle top can include a lock or catch mechanism enabling the body portion 30 to be held in a position exposing the spout 14. For example, as best shown in FIG. 2A, the body portion 30 can have a deformable portion 36 adjacent the top opening 34. The deformable portion 36 can enable the opening 34 to engage a shoulder 15 of the spout 14 when the body portion 30 is moved to expose the spout 14 for drinking. The deformable portion 36 can be flexible enough to allow the body portion 30 to be lifted past the shoulder 15 without also lifting the spout 14 open.

Alternatively, the stem 10 can include a rigid shoulder (not shown) for engaging a deformable member (not shown) formed within the hollow 31 of the body portion 30. In another example, the body portion 30 can include a catch (not shown) that engages a complementary catch (not shown) on the stem 10. These complimentary catches can be engaged by slightly turning the body portion 30 when positioned adjacent the cap 12. In yet another example, the body portion 30 can include a button mechanism (not shown) that engages and disengages a catch, slot, shoulder, or the like (not shown) on the stem 10. One of ordinary skill in the art will appreciate that a number of structures and methods can be used to hold the body portion 30 adjacent the cap 12 to expose the spout 14. Accordingly, one of ordinary skill in the art will appreciate that the disclosed top 10 is not strictly limited to those structures or methods explicitly shown or described herein.

Figure 2C:
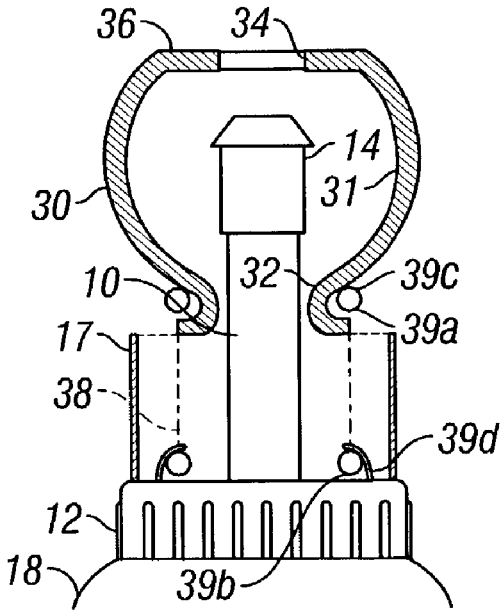

Referring to FIG. 2C, another embodiment of an interactive bottle top having a biased bobbing body 30 is illustrated. In this and other embodiments that follow, the same reference numerals indicate substantially similar components between embodiments and Figures. For example, the interactive bottle top includes a cap 12, a stem 10, and a spout 14, being substantially similar to those described above.

The bobbing body 30 for performing an interactive action defines an internal hollow or passage 31 for the stem 10. The body 30 is movable relative to the stem 10. The spout 14 can be exposed beyond a top opening 32 of the hollow or passage 31. A spring 38 for operating the interactive action is disposed about the stem 10. One end 39*a* of the spring 38 is attached to the body 30, and the other end 39*b* is attached to the cap 12. For example, the upper end 39*a* of the spring 38 can be disposed on and engaged within an internal recess of the body 30 at 39*c*. For example, the lower end 39*b* of the spring 38 can be attached to cap 12 by mechanical fasteners at 39*d*. Alternatively, the lower end 39*b* of the spring 38 can be attached to a retaining member or shoulder on the stem 10, such as the retaining member 11 in FIG. 3A below.

In a disengaged position shown in FIG. 2C, the body 30 is biased away from the cap 12, and the spout 14 is disposed within the passage 31. Activated by external movements, the spring 38 allows the body portion 30 to bob and move above the bottle 18. Preferably, the hollow or passage 31 of the body 30 allows for a substantial amount of movement of the body 30 over the spout 14 and stem 10. Preferably, the spring 38 is at least partially hidden or surrounded by a shroud 17 attached to the cap 12. The shroud 17 can be aesthetically designed to enhance the characteristics of the bobbing body 30.

In an engaged position not shown in FIG. 2C, the body 30 is positioned adjacent the cap 12 for a person to gain access to the spout 14. As evidenced above in the embodiment of FIGS. 2A–B, a number of structures and methods can be used to hold the body 30 adjacent the cap 12 to expose the spout 14. For brevity, such structures and methods disclosed above are not repeated here.

Figure 3A:
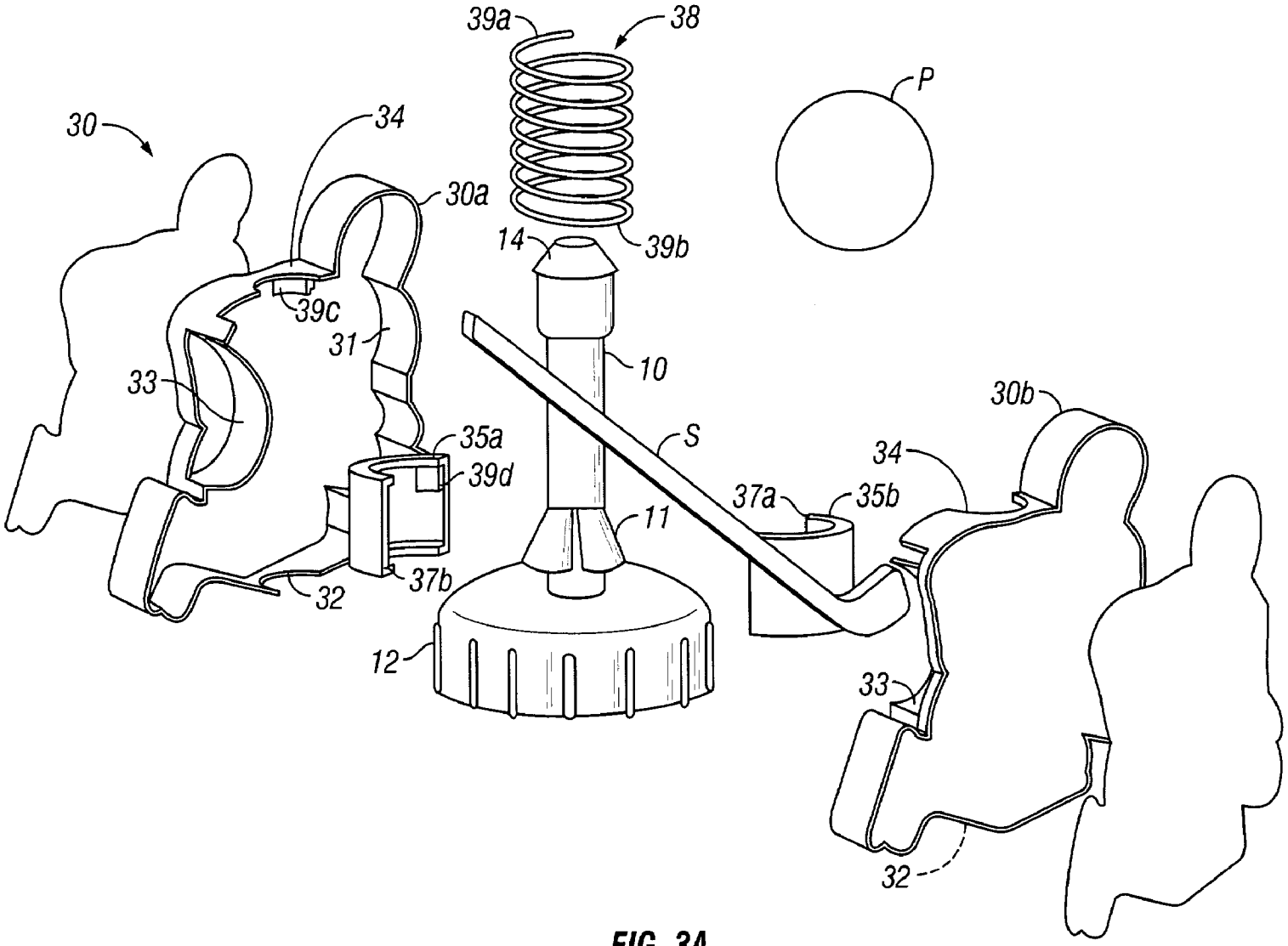
FIGS. 3A–B illustrate various views of another embodiment of an interactive bottle top having a biased body according to certain teachings of the present disclosure.
Figure 3B:
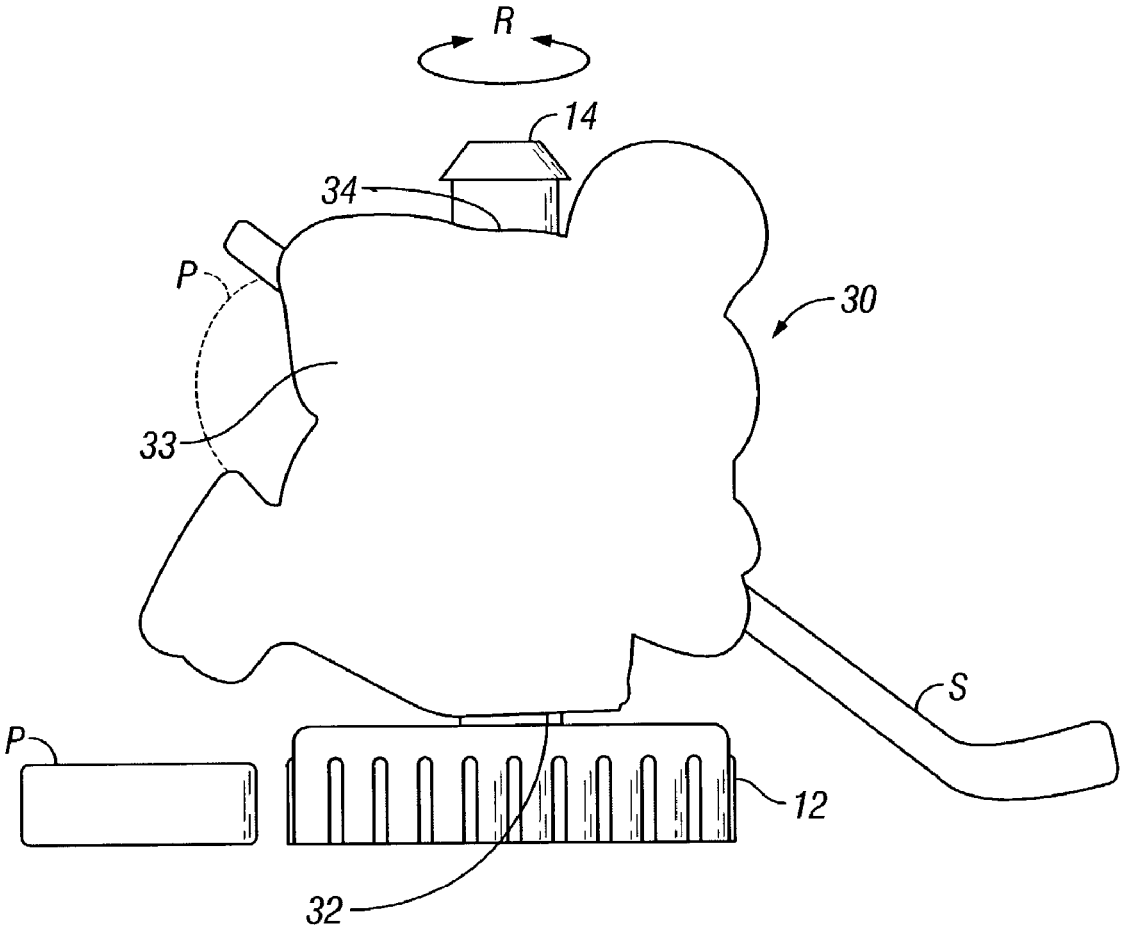

Referring to FIGS. 3A–B, another embodiment of an interactive bottle top having a biased body 30 for performing an interactive action is illustrated. The interactive bottle top includes a cap 12, a stem 10, and a spout 14, being substantially similar to those described above. As best shown in the exploded view of FIG. 3A, a spring 38 for operating the interactive action disposes about the stem 10. One end 39*b* of the spring 38 is held to the stem 10 and another end 39*a* of the spring 38 is held to the body 30. A number of techniques can be used to attach the ends 39*a–b* of the spring 38 to the stem 10 and the body 30. For example, a spring enclosure 35 formed from first and second parts 35*a*, 35*b* can be glued together about the stem 10. The spring enclosure 35 defines an upper flange 37*a* and a lower flange 37*b*. The lower flange 37*b* engages retaining members 11 on the stem 10. The upper flange 37*a* has an attachment 39*d* that holds the bottom 39*b* of the spring 38. The attachment 39*d* can be a shoulder, pocket, fastener, or the like to hold the end 39*b* of the spring 38 to the enclosure 35 and stem 10.

The biased body 30 is formed from first and second body portions 30*a* and 30*b* that define an internal hollow or passage 31. The body portions 30*a* and 30*b* attach together about the stem 10, spring enclosure 35, and spring 38. An ancillary member S, such as the hockey stick in the present example, can be held between the body portions 30*a* and 30*b* when attached together. A bottom opening 32 of the body 30 engages the spring enclosure 35 on the retaining member 11 so that the body 30 is held onto the stem 10. The top end 39*a* of the spring 38 is attached to the body 30 by techniques known in the art. For example, the top end 39*a* of the spring 38 can be attached to the internal hollow 31 of the body 30 by an attachment 39*c*. The attachment 39*c* can be a shoulder, pocket, fastener, or the like to hold the end 39*a* of the spring 38 to the body 30. The body 30 can further define a nest 33 for holding another ancillary member for play, such as the hockey puck P in the present example.

As best shown in the elevational view of FIG. 3B, the spout 14 is exposed beyond a top opening 34 of the body 30. For interactive play, the top can be removed from a beverage bottle (not shown) and placed on a table. The puck P, which could also be a ball or the like, can be removed from the nest 33 and placed on the table next to the top. The body 30 of the top can then be rotated by a user about the stem 10, which biases the torsion spring 38. When released, the body 30 then rotates about the stem 10 so that the hockey stick S can hit the puck P.

In the present embodiment, the body 30 is spring biased so that a user can hold the cap 12 and rotate the body about the stem 10. When the user lets go, the body 30 will then rotate about the stem 10 and the hockey stick S can be used to hit the puck P for active play. It will be appreciated that the disclosed top need not be spring biased. In other embodiments, for example, the body 30 may simply be free rotating about the stem 10. A user could thereby flick the body 30 with a finger, for example, to spin the body 30 about the stem 10 and hit the puck P with the stick S. It will also be appreciated that the disclosed top can have a number of alternative forms other than a hockey player. In the other embodiments, for example, the top can include a body of a soccer or football character having a portion used to kick a ball or the like.

Figure 4A:
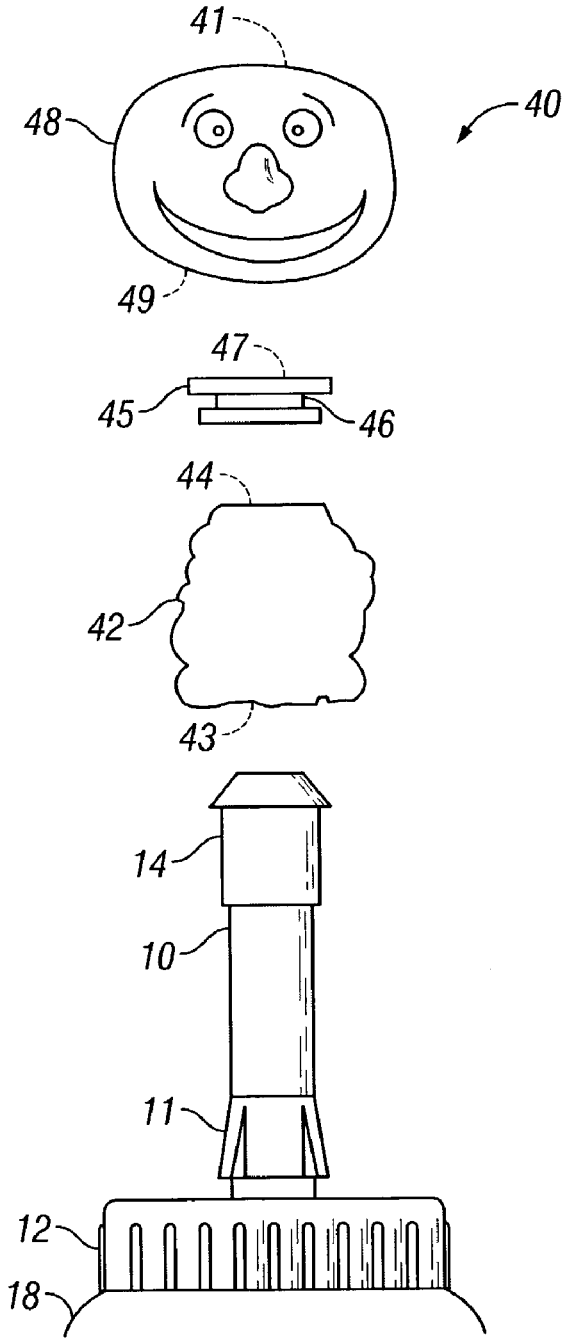
FIGS. 4A–B illustrate various views of an embodiment of an interactive bottle top having a manually movable body or element according to certain teachings of the present disclosure.
Figure 4B:
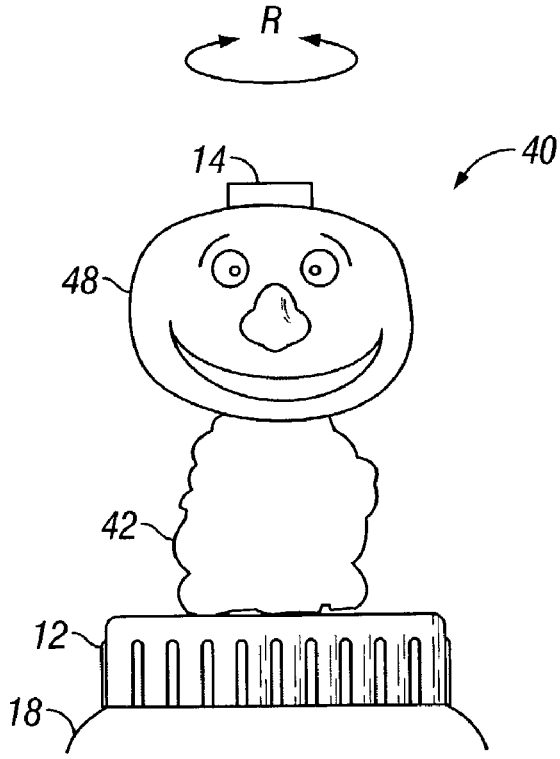

Referring to FIGS. 4A–B, an interactive bottle top 40 having a manually movable body or element is illustrated. The bottle top 40 includes a first body portion 42, an attachment member 45, and a second body portion 48. The attachment member 45 may be optional if one of the body portions 42 or 48 is appropriately formed. The first and second body portions 42 and 48 can be part of a figurine and can be rotocast from PVC. In addition, the bottle top 40 includes a stem 10, a cap 12, and a spout 14, such as disclosed above.

The first body portion 42 for performing an interactive action defines first and second openings 43 and 44. The second body portion 48 defines a top opening 41 and a bottom opening 49. The attachment member 45 for operating the interactive action is a ring defining a neck 45 about its circumference. The ring 45 can be composed of ABS, for example. The ring 45 is disposed in the bottom opening 49 of the second body portion 48 and is preferably glued therein. The ring 45 with attached second body portion 48 then snaps into the second opening 44 of the first body portion 42 so that the neck 46 engages the material surrounding the opening 44.

The first body portion 42 is disposed on the stem 10 adjacent the cap 12. The ring 45 defines an inner diameter 47 that fits over the spout 14. The first opening 43 engages retaining members 11 defined about the stem 10 to hold the first body portion 42 on the stem 10. With the first and second body portions 42 and 48 attached to the stem 10, the spout 14 extends through the top opening 41 in the second body 48, as best shown in FIG. 4B. The ring 45 enables the second body portion 48 to rotate relative to the first body portion 42. The separate ring 45 is optional in that one of the body portions 42 or 48 can be appropriately formed with a shoulder or neck 46 for engaging an opening 44 or 49 in the other body portion 42 or 48. It will be appreciated that the teachings of the present embodiment can be applied to create a number of interactive bottle tops having a manually movable body portion, element, or accessory. For example, the bottle top can include an action figurine having movable appendages.

Figure 5A:
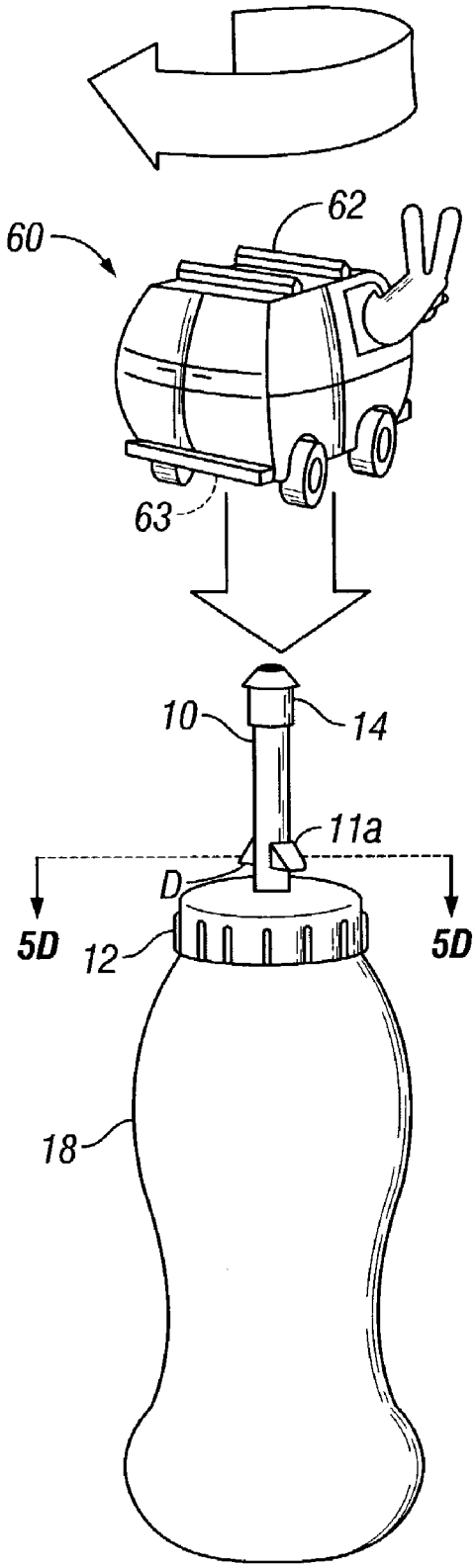
FIGS. 5A–D illustrate various views of an embodiment of an interactive bottle top having a removable body according to certain teachings of the present disclosure.

Referring to FIGS. 5A–D, an interactive bottle top having a removable body 60 is illustrated. In the present embodiment, the removable body 60 is a vehicle, but it is understood that the body 60 can have any other form or shape as desired. As best shown in FIG. 5A, the body 60 is removably attachable to the stem 10. To attach the body 60, the stem 10 is inserted into an opening 63 in the body 60, and the bottom of the body 60 is fit over retaining members or keys 11*a* disposed about the stem 10. The body 60 is then turned, for example one-quarter turn, to lock the bottom opening 63 of the body 60 on the retaining members 11*a*. With the body 60 attached, the spout 14 extends beyond another opening 62 defined in the top of the body 60. To remove the body 60, the above steps are reversed. Having the body 60 be removable as disclosed herein can be advantageous when the bottle 18 and stem 10 require washing. In addition, having the removable body 60 as disclosed herein enables the body 60 to be removed for active play.

Figure 5C:
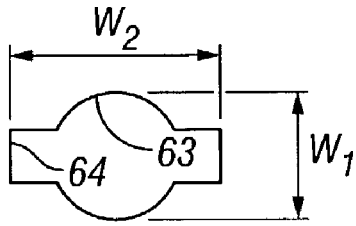
Figure 5D:
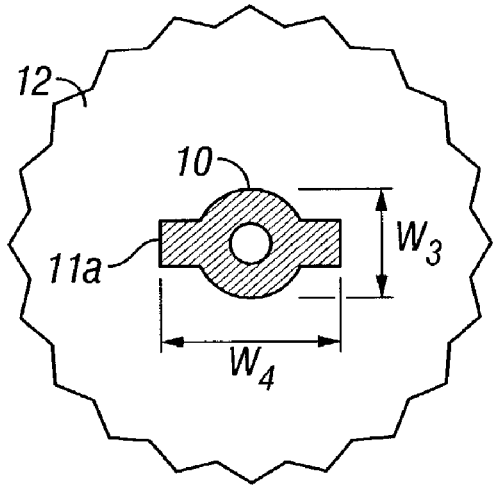
Figure 5B:
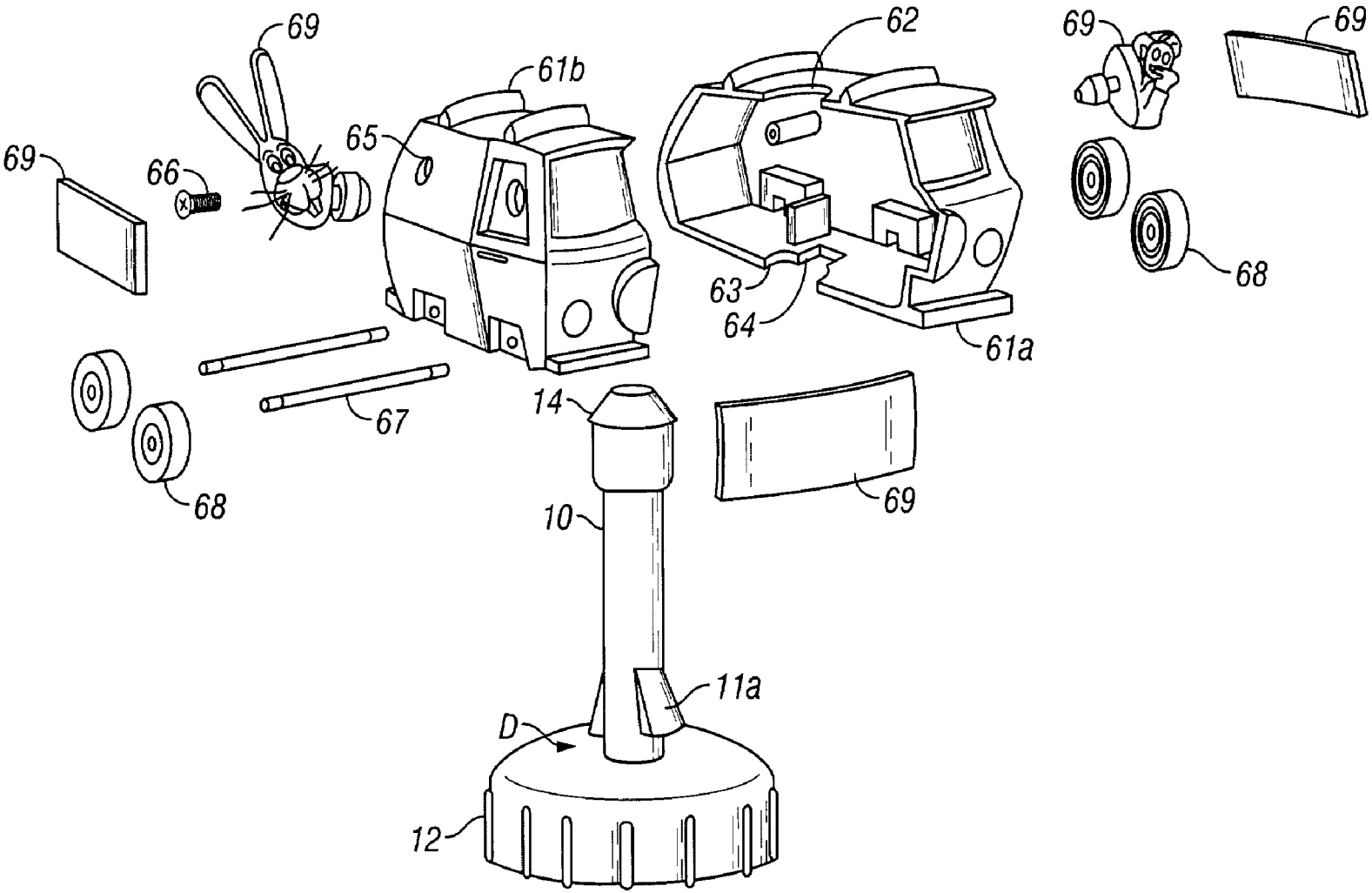

As best shown in the exploded view of FIG. 5B, the body 60 includes a first portion 61*a* and a second portion 61*b* that connect together to form the body 60. Preferably, for the vehicular body 60 of the present embodiment, the first and second portions 61*a* and 61*b* are composed of ABS. The body portions 61*a* and 61*b* are preferably connected together with one or more steel screws and affixed together with a suitable glue weld for use with the material of the body portions 61*a* and 61*b*.

To further enable the removable body 60 to be used for active play, two steel axles 67 with knurled ends are positioned through holes in the body portions 61*a* and 61*b*, and four wheels 68 composed of ABS are connected to the knurled ends of the axles 67. Additional elements 69 can be attached to the body 60. For example, the additional elements 69 can include movable or decorative members, such as characters composed of PVC that attach to holes in the body portions 61*a* and 61*b*. In addition, stickers 69 can be applied to the surface of the body 60 for decoration and for hiding the screws 66.

The bottom of each body portion 61*a* and 61*b* defines half of the bottom opening 63. The opening 63 has one or more key slots 64 defined therein. The top of each body portion 61*a* and 61*b* defines half of the top opening 62. A complete opening 63 having two key slots 64 as formed in the bottom of the vehicle 60 when the body portions 61*a* and 61*b* are connected together is shown in FIG. 5C. The complete opening 63 with two key slots 64 can have the dimensions $W_1$ and $W_2$ of approximately 15.0-mm by 20.4-mm for use with a conventionally sized stem 10, cap 12, and bottle 18.

As best shown in FIG. 5A, the stem 10 includes two retaining members or angled keys 11*a*. This arrangement of the retaining members 11*a* is suitable for bodies of interactive bottle tops disclosed herein that are removable from the stem 10. As shown in FIG. 5D, the cross-sectional dimensions $W_3$ and $W_4$ of the stem 10 and retaining members 11*a* can be approximately 14.6-mm by 20.0-mm for use with the bottom opening 63 with two key slots 64 described above in FIG. 5C. Preferably, for the vehicular body 60 of the present embodiment, the distance D between the shoulders of the retaining members 11*a* and the surface of the cap 12 is about 3-mm.

To position the body 60 on the stem 10, the stem 10 is inserted through the complete opening 63 with the key slots 64 aligning with the keys 11*a*. The body 60 is turned, and the edges of the opening 63 engage the shoulders of the keys 11*a* to hold the body 60 in place. The body 60 can be prevented from inadvertent turning by friction. In addition, to prevent inadvertent turning of the body 60, the wheels 68 or another portion of the body 60 can engage raised nodules (not shown) on the cap 12 when the body 60 is rotated. Alternatively, an inner surface of the body 60 adjacent the bottom opening 63 can include detents to engage the keys 11*a* once the body 60 is turned.

Figure 6A:
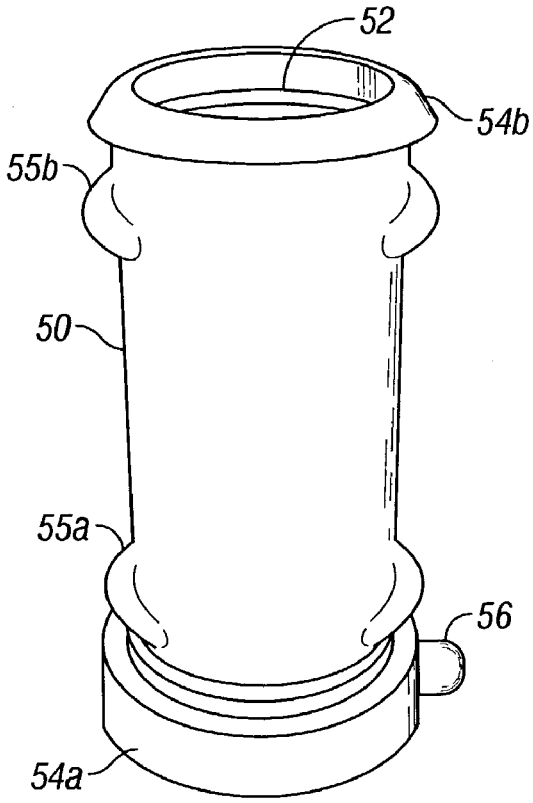
FIGS. 6A–C illustrate various views of an embodiment of a device for removably attaching a body to a stem of a bottle top according to certain teachings of the present disclosure.
Figure 6B:
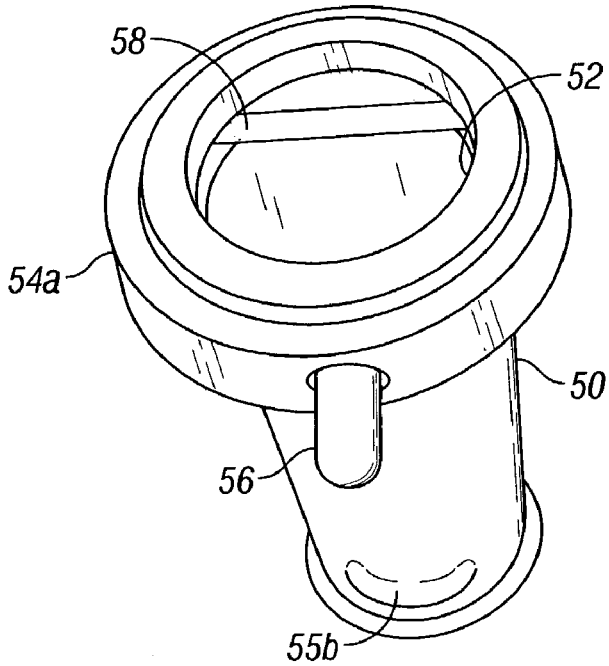
Figure 6C:
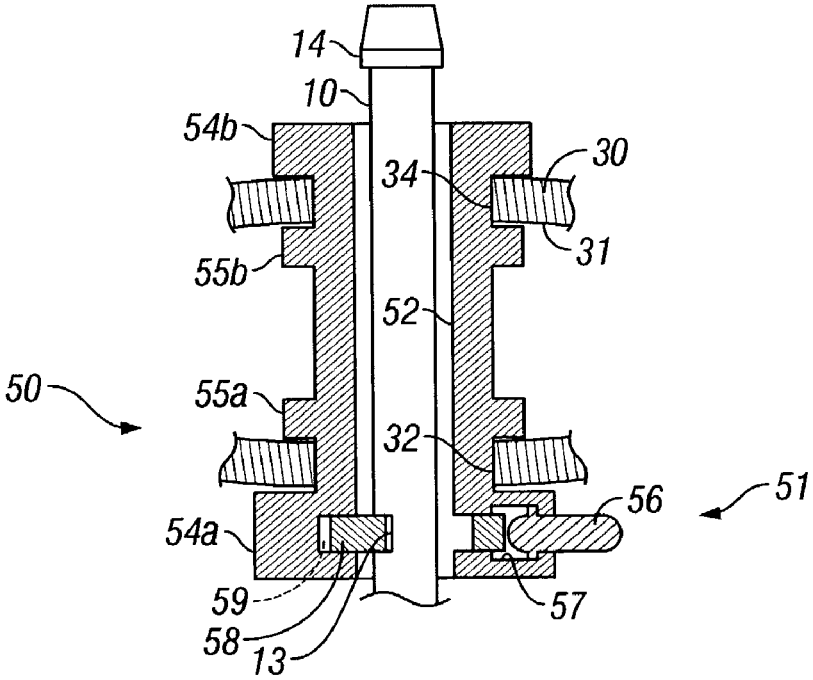

Referring to FIGS. 6A–C, an embodiment of a device 50 for removably attaching a body 30 to a stem 10 is illustrated. The device 50 defines a bore 52 being open at both ends. A movable button 56 is connected to the device 50. As best shown in FIG. 6C, the movable button 56 is exposed outside the decorative body 30 and can be incorporated into the design of the body 30. For example, the button 56 can be a bell on the outside of a car-shaped body or can be incorporated into the arm of an action figurine.

As best shown in the cross-sectional view of FIG. 6C, the device 50 is positioned in a passage or hollow 31 of the body 30. To hold the device 50 in the body 30, the device 50 includes flanges 54*a* and 54*b* at both ends of the device 50. Spaced adjacent both flanges 54*a* and 54*b* are detents 55*a* and 55*b*. The spaces between the flanges 54 and detents 55 capture edges of openings 32 and 34 defined in the body 30. The device 50 can be held in this manner by mere engagement between the flanges 54 and detents 55 or can be further held by gluing or other methods for affixing the body 30 to the device 50.

The device 50 positions on the stem 10 by inserting the stem 10 through the bore 52. The width of the bore 52 is great enough to allow passage of the spout 14 through the bore 52. The device 50 includes a locking mechanism 51, enabling a person to remove and reattach the device 50 with body 30 to the stem 10. Depressing the button 56 increases an inner dimension of the locking mechanism 51 within the bore 52. When the button 56 is pressed, the locking mechanism 51 is disengaged and is capable of surpassing a lock, which can be a catch, tooth, neck, or shoulder defined about the stem 10. When the button 56 is not pressed, the locking mechanism 51 is engaged and is capable of locking on the lock on the stem 10.

In the present embodiment of the device 50, the locking mechanism 51 includes the button 56, a locking member or ring 58, and a catch 13. The button 56 is movably disposed in an aperture 57. The button 56 has one end exposed outside the device 50 being accessible for a person to depress the button 56. Another end of the button 56 is held within the aperture 57 by a shoulder or like structure to prevent removal of the button 56. When pressed into the aperture 57, the button 56 engages the locking member or ring 58 disposed about the stem 10. Pressing the button 56 moves the locking member 58, and an inner edge of the locking member 58 is disengaged from the catch 13, which can be a neck, slot, or shoulder defined in the stem 10. Once the inner edge is disengaged from the lock 13, the device 50 with attached body 30 can slide off the stem 10. The inner dimension of the locking member 58 is great enough to surpass the width of the spout 14 when the device 50 is attached or removed from the stem 10. The locking member 58 can be flexible so that it is biased to engage the lock 13 when the button 56 is not pressed. Alternatively, a biasing member (not shown) can be positioned at 59 and can bias the locking member 58 to engage the lock 13.

Figure 7A:
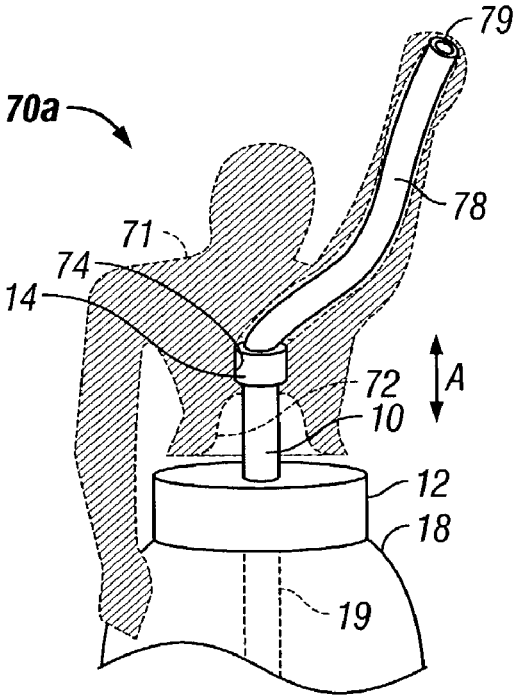
FIGS. 7A–C illustrate various embodiments of interactive bottle tops having squirting or squeezable bodies according to certain teachings of the present disclosure.

Referring to FIG. 7A, an embodiment of an interactive bottle top 70*a* for performing an interactive action of squirting liquid is illustrated. The bottle top 70*a* includes a body 71, which can be an action figurine, for example. The body 71 defines an internal hollow 72 for the stem 10. A portion 74 of the body 71 is affixed to, connected to, or engaged with the spout 14 on the stem 10. For example, the spout 14 can be disposed in a recess or undercut 74 defined by the hollow 72 so that shoulders formed by the recess 74 engage the top and bottom of the spout 14. The side of the recess 74 can also engage or grip the outer surface of the spout 14. One skilled in art will recognize that a number of other structures or methods for engaging, attaching, or connecting the body 71 to the stem 10 and spout 14 can be used.

The body 71 is movably disposed on the stem 10 and is capable of opening and closing the spout 14 for operating the interactive action of squirting liquid. Moving the body 71 away from the cap 12 opens the spout 14. In one aspect, the body 71 is removable from the spout 14 by applying a sufficient amount of force to remove the spout 14 from the recess 74. The ability to remove the body 71 from the stem 10 can be advantageous when cleaning of the bottle 18 and stem 10 are required.

A tube 78 is disposed in the body 71. Alternatively, the body 71 can integrally define a tubular passage or channel. One end of the tube or channel 78 is disposed adjacent the tip of the spout 14. This end of the tube or channel 78 can be simply held adjacent the tip of the spout 14. Alternatively, the tube 78 can be permanently attached to the spout 14. Another end of the tube or channel 78 forms an outlet 79. With the body 71 moved away from the cap 12 and the spout 14 opened, squeezing the bottle 18 can deliver liquid through the spout 14 and into the tube or channel 78 for squirting the liquid from the outlet 79.

The outlet 79 can be incorporated into the design of the body 71. For example, the liquid can be squirted from a hand, mouth, or eyes of an action figurine. The squirting bottle top 70*a* can be used to squirt a marketed liquid, such as juice, for drinking. In addition, the squirting top 70*a* can be used for active play when the juice is gone. For example, the empty bottle 18 can be loaded with water and can be used for active play with the squirting bottle top 70*a*. In addition, the stem 10 can include a straw 19 disposed in the bottle 18 to allow liquid to be conveyed through the tube 78 by suction instead of squeezing of the bottle 18.

Figure 7B:
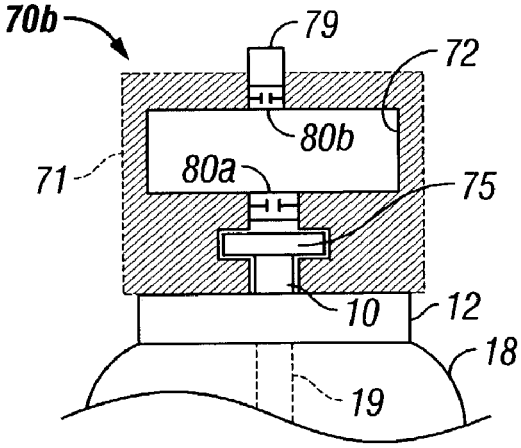

Referring to FIG. 7B, another embodiment of an interactive bottle top 70*b* for performing an interactive action of squirting liquid is illustrated. The bottle top 70*b* includes a body 71 defining a deformable cavity or reservoir 72 for operating the interactive action of squirting liquid. The reservoir 72 is capable of holding liquid from the bottle 18, as described below. Squeezing the body 71 can elicit squirting as described below. The body 71 can removably or permanently attach to the stem 10 using a mechanism or method 75 substantially similar to those disclosed herein. Preferably, the mechanism 75 allows the body 71 to be removed for active play and for cleaning the stem 10 separate from the body 71.

The body 71 has an inlet adjacent the stem 10 for receiving liquid from the bottle 18 and has an outlet 79 for drinking the liquid. The inlet has a first valve 80*a*, and the outlet 79 has a second valve 80*b*. For example, the valves 80*a* and 80*b* can be diaphragms having splits defined therein. The valves 80*a* and 80*b* are capable of containing the liquid in the reservoir 72 in the absence of significant external forces or pressure differentials. In one aspect, the first valve 80*a* adjacent the inlet can allow liquid in the reservoir to slowly empty back to the bottle 18 when not in use. For example, the first valve 80*a* can define a significantly larger slit or a partial opening in the diaphragm. The return of liquid from the reservoir 72 to the bottle 18 can be advantageous when the bottle 18 and squeezable body 71 are not being used.

With suction on the outlet 79, a person can draw liquid from the bottle 18 into the reservoir 72. The bottle 18 can include a straw 19 disposed therein and connected to the stem 10 so that the bottle 18 need not be tilted when drawing the liquid from the bottle 18. The drawn liquid can collect in the reservoir 72 and can be drawn through the outlet 79 for drinking. After initial suction is ceased, an amount of liquid is left in the reservoir 72. Squeezing the body 71 can then force the liquid in the reservoir 72 past the second valve 80*b* and squirt the liquid from the outlet 79. To ensure that a considerable amount of liquid squirts from the outlet 79, the first valve 80*a* near the inlet can be biased to close when adverse pressure is applied during squeezing of the body 71.

Figure 7C:
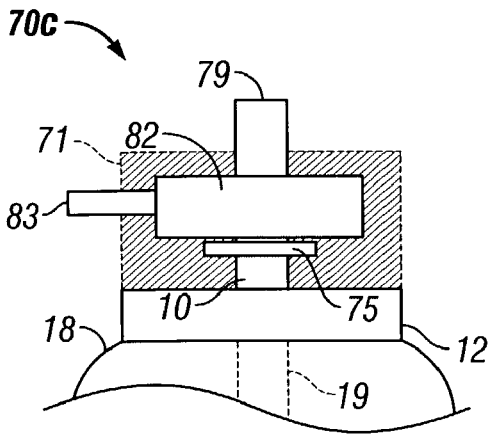

Referring to FIG. 7C, yet another interactive bottle top 70*c* for squirting liquid is illustrated. The bottle top 70*c* includes a body 71, which can removably or permanently attach to the stem 10 using a mechanism or method 75 substantially similar to those disclosed herein. Preferably, the mechanism 75 allows the body 71 to be removed for active play and for cleaning the stem 10 separate from the body 71. The bottle top 70*c* also includes a pump mechanism 82 for performing the interactive action of squirting liquid and includes a trigger 83 for operating the pump mechanism 82. To squirt liquid from the body 71, the trigger 82 is activated, causing the pump 82 to draw liquid from the bottle 18 through a tube or straw 19.

In addition to the embodiments of squeezable and squirting bottle tops disclosed above, additional embodiments of disclosed bottle tops can include a body performing other desired interactive actions when squeezed. In one aspect of another interactive action, squeezing a body of an embodiment of a disclosed interactive bottle top can cause a substance contained in cavities of the body to ooze from outlets. For example, a gooey substance can ooze from the eyes, nose, or mouth of a character as a person squeezes the body. In another aspect of another interactive action, squeezing a body of an embodiment of a disclosed interactive bottle top can force air or liquid contained in a cavity of the body to execute a function. For example, squeezing the body of the bottle top can launch a ball from the body or can cause elements floating in liquid within the body to move therein.

Figure 8A:
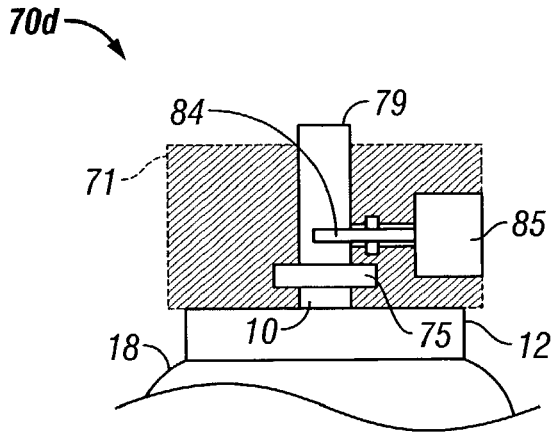
FIGS. 8A–B illustrate embodiments of interactive bottle tops having mechanical mechanisms according to certain teachings of the present disclosure.

Referring to FIG. 8A, an embodiment of an interactive bottle top 70*d* being mechanically operated is illustrated. In the present embodiment, the disclosed bottle top 70*d* is mechanically operated by liquid drawn from the bottle 18. The bottle top 70*d* includes a body 71, a rotor 84 for operating an interactive action, and an active member or mechanism 85 for performing the interactive action. The body 71 can removably or permanently attach to the stem 10 using a mechanism or method 75 substantially similar to those disclosed herein. Preferably, the mechanism 75 allows the body 71 to be removed for active play and for cleaning the stem 10 separate from the body 71.

The rotor 84 for operating the interactive action is housed in the body 71 and is mechanically coupled to the active member or mechanism 85 for performing the interactive action. Squeezing the bottle 18 or suction on an outlet 79 forces liquid from the bottle 18 past impellers or blades of the rotor 84. The rotor 84 then transfers the motion of the liquid to the active member or mechanism 85. The rotor 84 can transfer rotational motion to the active member 85 using gearing or other structures and methods known in the art.

With the transferred motion, the active member or mechanism 85 performs a desired interactive action. For example, motion of the rotor 84 can cause the active member 85 to produce sparks by friction. Motion of the rotor 84 can cause the active member 85 to generate current to light LED's or to produce sounds. The active member 85 can include a number of devices disclosed herein. Furthermore, the rotor 84 and active member 85 can produce a number of desired interactive actions disclosed herein.

Figure 8B:
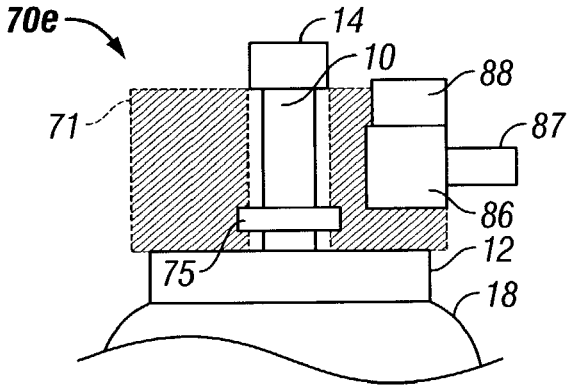

Referring to FIG. 8B, an embodiment of an interactive bottle top 70*e* being mechanically motorized is illustrated. The bottle top 70*e* includes a body 71, which can removably or permanently attach to the stem 10 using a mechanism or method 75 substantially similar to those disclosed herein. Preferably, the mechanism 75 allows the body 71 to be removed for active play and for cleaning the stem 10 separate from the body 71.

The body 71 has a motor 86 for operating an interactive action and includes an activator 87 for activating the motor 86. Once activated by the activator 87, the motor 86 activates a display mechanism or member 88 for performing the interactive action. The motor 86 with activator 87 can include, but is not limited to, a wind-up mechanism 86 activated by an exposed knob 87, a motor 86 activated by a pull-back 87, a flywheel 86 activated by direct revving using a surface 87 of the flywheel, or a flywheel 86 activated by a zip strip 87.

For example, the motor 86 with activator 87 can include a wind-up mechanism 86 activated by an exposed knob 87. The knob 87 winds up the motor 86 when turned. The motor 86 can unwind when released or can be set in motion via a secondary motion, such as waving a magnetic wand adjacent a magnetic release mechanism (not shown) within the wind-up mechanism 86. The knob 87 can be incorporated into the design of the body 71. For example, the knob 87 can be attached to an arm or other appendage, piece of clothing, or other attachment to the body 71 for winding the motor 86.

The display mechanism 88 for performing the interactive action can include, for example, a flywheel that causes a desired motion or display. For example, the flywheel can spin against a sparking material to produce sparks. In addition, the display mechanism 88 can include a movable element, such as an arm of a figurine, being moved by the motor 86. A transfer mechanism (not shown), such as gearing or linkages, can be provided to transfer motion between the motor 86 and the movable display mechanism 88, such as the arm of a figurine.

A number of structures or mechanism for use with disclosed bottle tops can be used for performing and operating interactive actions. For example, the interactive bottle tops in the present disclosure can include a body that is capable of being removed for active play. In one aspect, the body can perform desired interactive actions that are powered by wind-up, by pullback, or by flywheel type motors. In yet another aspect, the body can be removed and can float on the water. The body can then be powered through water using a mechanical motor and propeller. In another aspect, the body can be propelled by pumping pressurized water, can be propelled by launching, or can be propelled by mechanical rotation.

Figure 9A:
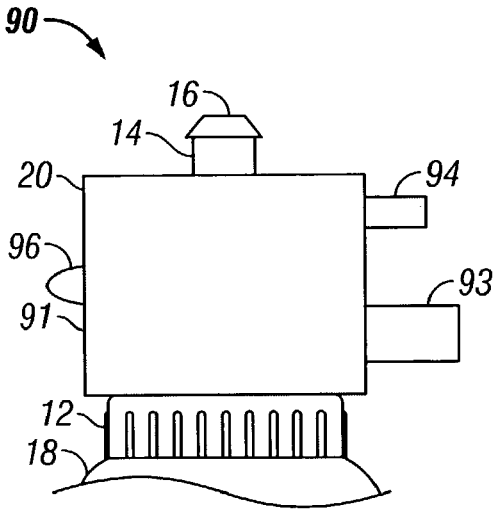
FIGS. 9A–10D illustrate embodiments of interactive bottle tops having electrical mechanisms according to certain teachings of the present disclosure.
Figure 9B:
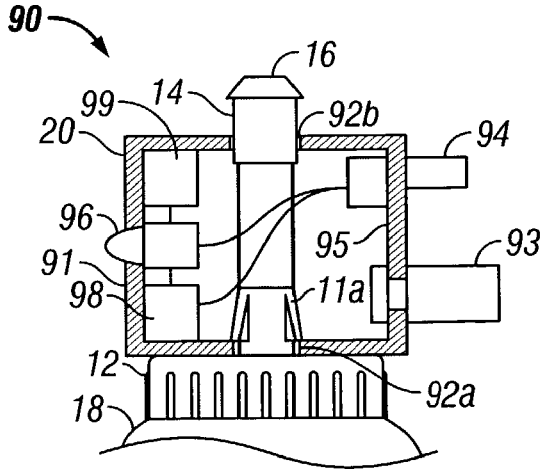

Referring to FIGS. 9A–B, an embodiment of an interactive bottle top 90 having electrical components is illustrated. The bottle top 90 includes a body 91, which can be formed as one piece or from a plurality of pieces. The body 91 is attached to the stem 10 and is preferably removable, which allows the electrical components described below to be removed when the stem is cleaned. The structure or method for removing the body 91 from the stem can be substantially similar to those disclosed herein. For example, as shown in FIG. 9A, the body 91 can define a key slot 92*a* that engages retaining members 11*a*, such as disclosed above.

The body 91 defines a top opening 92*b*, from which the spout 14 extends. The body 91 can have any particular shape or design and can include one or more components 93 fixedly or movably attached to the body 91 using techniques known in the art. As best shown in the partially exposed view of FIG. 9B, the body 91 defines a housing 95 therein. The housing 95 holds electronic components for operating and performing an interactive action, such as a power supply, wires, resistors, capacitors, circuit boards, integrated circuits, switches, speakers, etc.

The body 91 can include lights for performing an interactive action and can include buttons for operating the interaction action. For example, the body 91 in FIG. 9A includes a light 96, which can be an LED or an incandescent light, mounted thereon. The light 96 is operated by a button or switch 94 mounted on the body 91. The light 96 and button 94 are connected to a power supply 99 housed in the body 91. Preferably, the power supply 99 includes one or more button cells. The button 94 can also be used to operate a sound from a speaker 98, such as a piezoelectric speaker, housed in the body 91, as shown in FIG. 9B. The placement of lights 96 and buttons 94 can facilitate decoration of the body 91, and the sound produced by the speaker 98 can be particularly suited for the decorative aspect of the body 91. It is understood that other electronics, such as wires, resistors, capacitors, circuit boards, and integrated circuits, for example, may be needed to activate and operate the light and speaker.

Figure 10A:
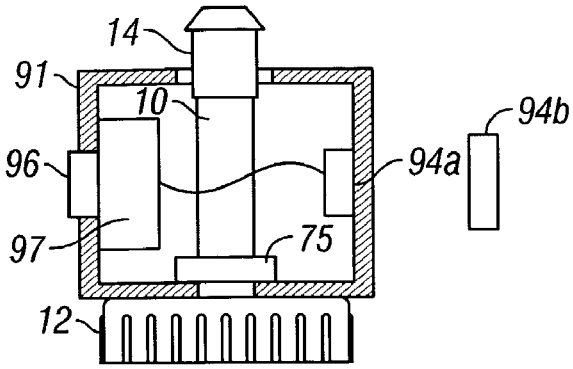

In addition to operating and activating light or sound with a button or switch, a secondary form of operation and activation, including but not limited to, magnetic effect, environmental light, or environmental sound, can operate and activate the light or sound. For example, in FIG. 10A, the body 91 of a top can house a magnetic sensor 94*a* connected to an electronic component 97. The magnetic sensor 94*a*, which can be a Hall effect sensor, for example, responds to a magnetic wand 94*b* placed adjacent to the sensor 94*a* and activates lights or sounds 96 of the electronic component 97.

Figure 10B:
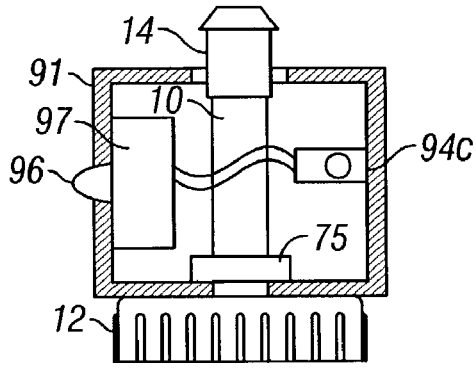
Figure 10C:
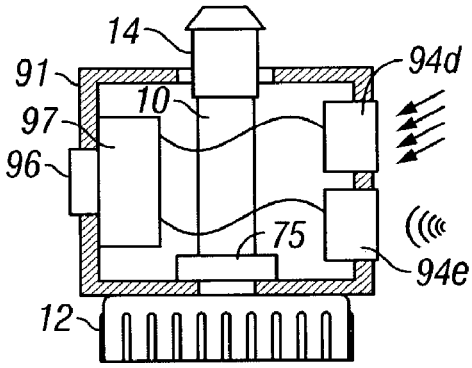

In another example of FIG. 10B, the body 91 can house a motion switch 94*c* connected to electronic component 97. The motion switch 94*c* responds to movement of the body 91 when bumped or tilted, for example, and activates lights or sounds 96 of the electronic component 97. In yet another example of FIG. 10C, a light sensor 94*d*, such as photosensitive cell, can be connected to the electronic component 97. The light sensor 94*d* responds to changes in environmental light and activates lights or sound 96 of the electronic component 97. In a further example of FIG. 10C, a sound sensor 94*e* can be connected to the electronic component 97 and can respond to environmental sounds to activate the lights or sound 96 of the electronic component 97.

Figure 10D:
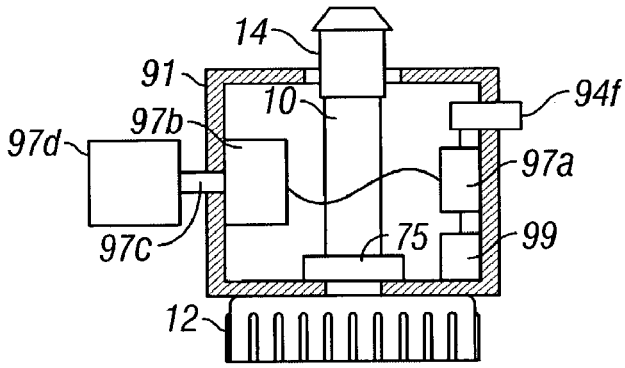

In FIG. 10D, the body 91 can house an electric motor 97*b* for operating an interactive action. The electric motor 97*b* is connected to an articulating member 97*d* coupled to the body 91 for performing the interactive action. The electric motor 97*b* is connected to the electronic component 97*a* that operates and controls the motor 97*b*. The electronic component 97*a* is connected to a battery 99 and can be activated by an activation device 94*f*, which can be a manual button, a magnetic sensor, a light sensor, or a sound sensor, for example. When activated, the motor 97*b* can move the articulating member 97*d* coupled to the body 91. Consequently, gears or linkages 97*c* among other mechanisms can be coupled between the motor 97*b* and the articulating member 97*d* for converting the motion of the motor 97*b* to movement of articulating member 97*d*.

The above examples and the present disclosure, show that a number of interactive electronic and electromechanical components can be incorporated into a removable body of an interactive bottle top according to the present disclosure.

Figure 11B:
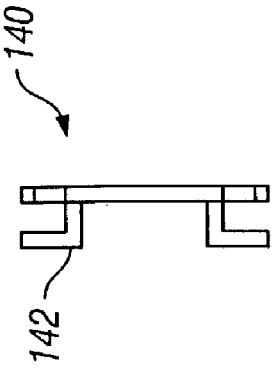
FIG. 11B illustrates a side view of the mounting member the disclosed bottle top of FIG. 11A.
Figure 11A:
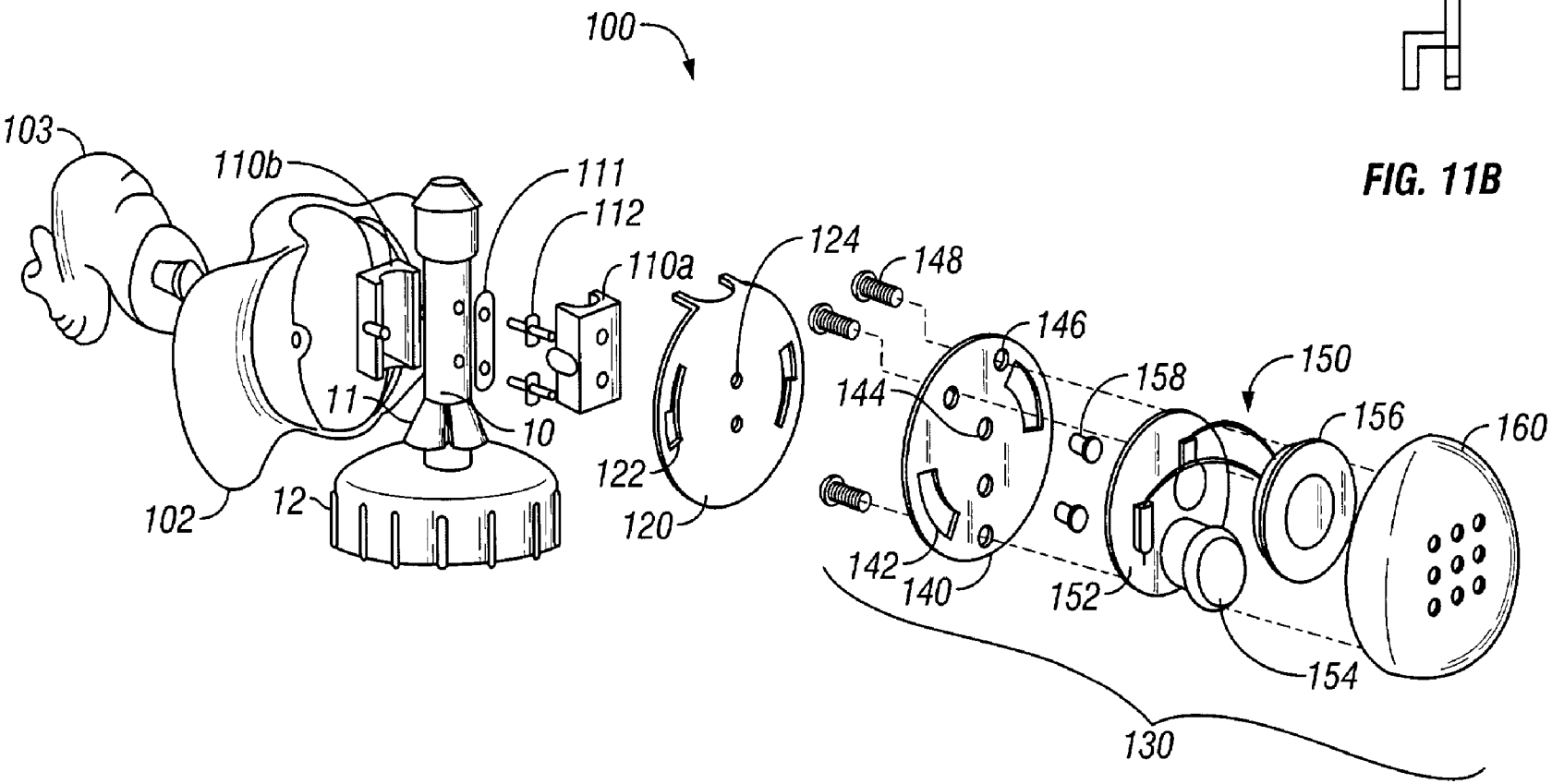
FIG. 11A illustrates an exploded view of an embodiment of an interactive bottle top having a liquid activated mechanism according to certain teachings of the present disclosure.

Referring to FIG. 11A, an interactive bottle top 100 having electronic and/or electromechanical components for performing and operating an interacting action that is activated by liquid is illustrated. The bottle top 100 includes a cap 12, a stem 10, and a spout 14. The bottle top 100 also includes a first body member 102, holders 110*a* and 110*a*, conductive members or pins 112, and a receiving member 120. The bottle top 100 can also include a gasket or seal 111. These components 102, 110, 111, 112, and 120 permanently attach to the stem 10 as described below.

The conductive members or pins 112 for operating the interactive action dispose into holes defined in one side of the stem 10. Distal ends of the pins 112 are disposed in the annulus of the stem 10. Contact with liquid passing through the stem 10 produces a closed circuit between the distal ends of the pins 112. The pins 112 are preferably stainless steel, but could also be any other conductive material. Preferably, the pins 112 include shoulders to limit their insertion into the stem 10. Preferably, a gasket or other seal 111 is positioned between the shoulders of the pins 112 and the stem 10 to prevent inadvertent leaking from the holes. The holders 110*a* and 110*b* connect together about the stem 10 to hold the pins 112 in place. The holders 110*a* and 110*b* are preferably composed of ABS and are attached together by glue or other methods known in the art. One of the holders 110*a* defines holes through which proximal ends of the pins 112 extend.

The first body portion 102 positions adjacent the stem 10. The first body portion 102 forms a part of the decorative outside of the bottle top 100 and can have any particular shape. In addition, decorative elements 103 can attach to the first body portion 102. The receiving member 120 also positions adjacent the stem 10. The first body portion 102 and receiving member 120 attach together around the stem 10, holders 110, and pins 112 by methods known in the art.

In the present embodiment, the stem 10 includes a plurality of retaining members 11 disposed thereon. These retaining members 11 permanently hold the first body portion 102 with attached receiving member 120 on the stem 10. It is understood that other methods can also be employed to hold the first body portion 102 and receiving member 120 on the stem 10. The receiving member 120 defines holes 124 through which the proximal ends of the pins 112 extend. The receiving member 120 also defines slots 122 for connecting to additional components of the bottle top 100 described below.

The bottle top 100 further includes a removable portion 130, which houses additional electronic and/or electromechanical components for performing and operating the interactive action. This portion 130 removably attaches to the receiving member 120 so that the electronic components can be unattached from the stem 10 when washed. The removable portion 130 includes a mounting member 140, an electronic member 150, and a second body member 160. The mounting member 140 and second body portion 160 are connected together. In the present embodiment, screws 148 are used, but other methods can also be employed. The mounting member 140 and second body portion 160 house the electronic member 150 therebetween.

The mounting member 140 includes retainers 142, which lock into the slots 122 of the receiving member 120. (The mounting member 140 and retainers 142 are shown in a side view in FIG. 11B). The mounting member 140 as shown in FIG. 11A also defines holes 144 aligning with the proximal ends of the pins 112 and defines holes 146 for receiving the screws 148. The electronic member 150 holds necessary electronics 152 for operating and performing the interactive action for the interactive bottle top 100. For example, the electronic member 150 can have button cell batteries 154, an integrated circuit, and a speaker 156, among other electronic components. Contacts 158, preferably composed of steel, position in the holes 144 of the mounting member 140 and electrically connect the electronic components 152 with the proximal ends of the pins 112 disposed though the holes 124 in the receiving member 120. The second body portion 160 is preferably composed of ABS and can have openings for conveying sound. The second body portion 160 can also include switches or lights, among other external components not shown.

The removable portion 130 connects to the fixed portion of the bottle top 100 by inserting the retainer 142 on the mounting member 140 in the slots 122 defined in the receiving member 120 and turning the removable portion 130. It is understood that other methods can be employed to removably attach the members 120 and 140 together. The proximal ends of the pins 112 extending beyond the receiving member 120 contact the contacts 158 of the removable portion 130. When liquid is passed through the annulus of the stem 10, the liquid creates a closed circuit between the distal ends of the pins 112 and activates the electronic components 152 of the removable portion 130.

In addition to or in an alternative to having lights and/or sound, the removable portion 130 can house an electric motor (not shown), which can be battery powered and activated by the passage of liquid through the stem 10. The motor can move one or more movable elements (not shown) mounted on the second body portion 160. Consequently, the removable portion 130 can also house gearing or linkages (not shown), among other mechanisms for converting the motion of the motor to movement of external movable elements. The present disclosure shows that a number of interactive electronic and/or electromechanical components can be incorporated into the removable portion 130 of the disclosed bottle tops.

Figure 12A:
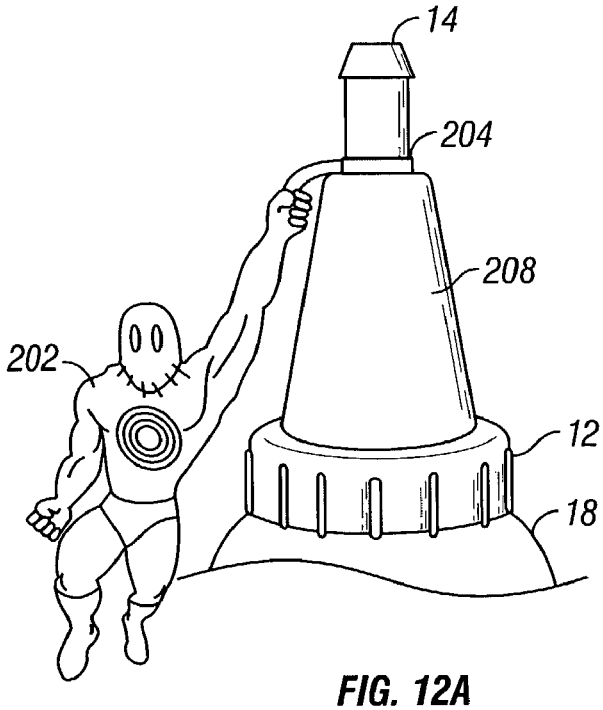
FIGS. 12A–B illustrate an embodiment of an interactive bottle top having a body for spinning according to certain teachings of the present disclosure.
Figure 12B:
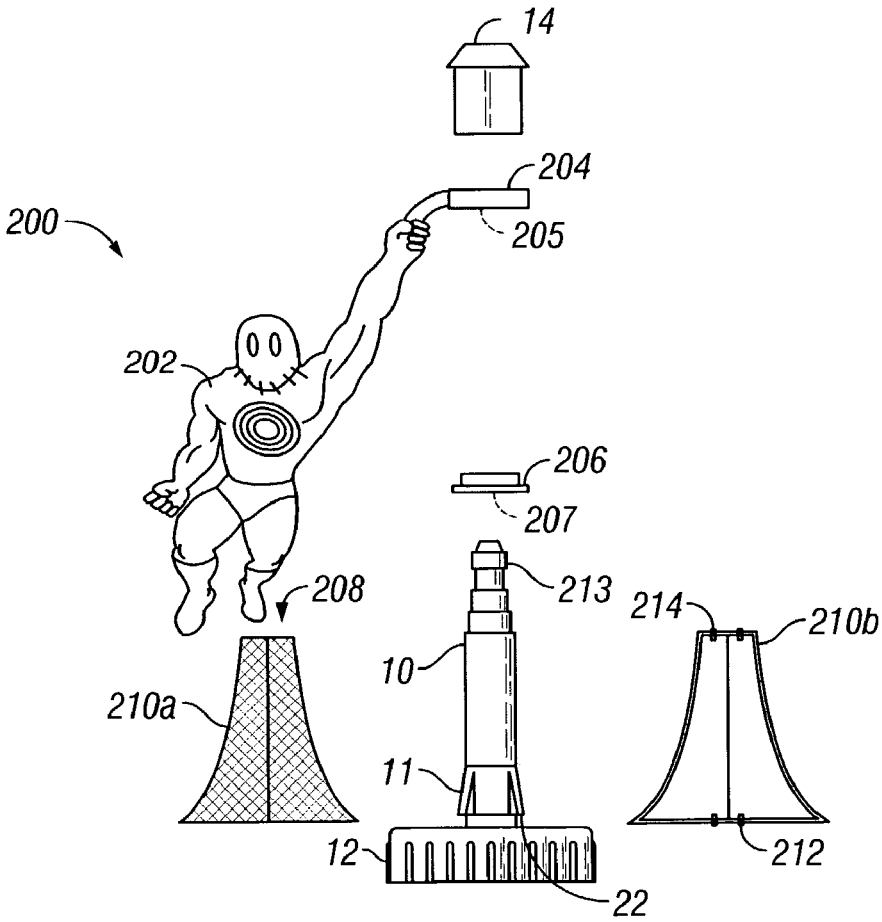

Referring to FIGS. 12A–B, an embodiment of an interactive bottle top 200 having a body 202 for performing an interactive action of spinning is illustrated. The bottle top 200 includes a cap 12, a stem 10, and a spout 14. The bottle top 200 also includes a body member 202, an attachment member 204, a washer 206, and a mounting member 208. The mounting member 208 includes first and second portions 210*a–b* that connect together about the stem 10. For example, the portions 210*a–b* can define openings 212 and 214 for accommodating the stem 10, which can include tabs 11 for engaging the mounting member 208. The washer 206, which is preferably composed of nylon or other slippery material, disposes on the stem 10 and provides a surface on which the attachment member 204 can rotate. The attachment member 204 is attached to the body member 202, which can be a character or figurine. The attachment member 204 also disposes on the stem 10 and is rotatable thereon for operating the interactive action of spinning. These components 202, 204, 206, and 208 are assembly before the tip 14 is attached to the end 13 of the stem 10. With these components 202, 204, 206, and 208 assembled, the tip 14 attaches to the end 13 of the stem 10, and the body 202 can be rotated about the attachment member 204 and stem 10 by holding and spinning a bottle to which the cap 12 is attached.

Figure 13B:
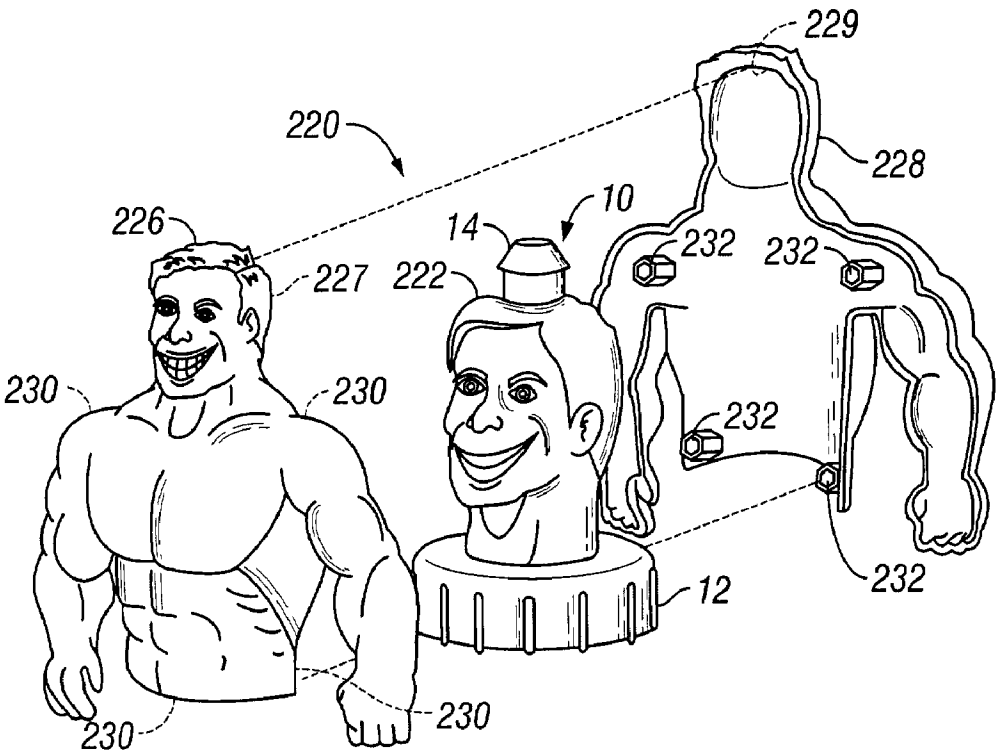
FIGS. 13A–B illustrate an embodiment of an interactive bottle top having a hidden body and a removable body according to certain teachings of the present disclosure.
Figure 13A:
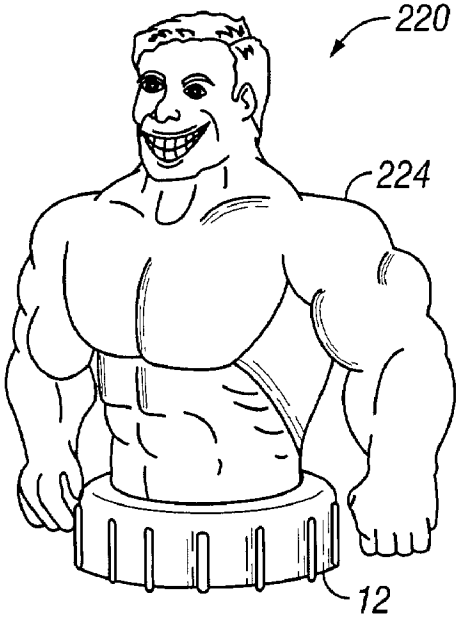

Referring to FIGS. 13A–B, an embodiment of an interactive bottle top 220 having a hidden body 222 and a removable body 224 is illustrated. The hidden body 222 attaches to the stem 10 using techniques disclosed herein so that the spout 14 is accessible for drinking. The removable body 224 has a first portion 226 and a second portion 228. The first and second portions 226 and 228 press fit together to hide the body 222 using snap fit members 230 and 232.

Figure 14A:
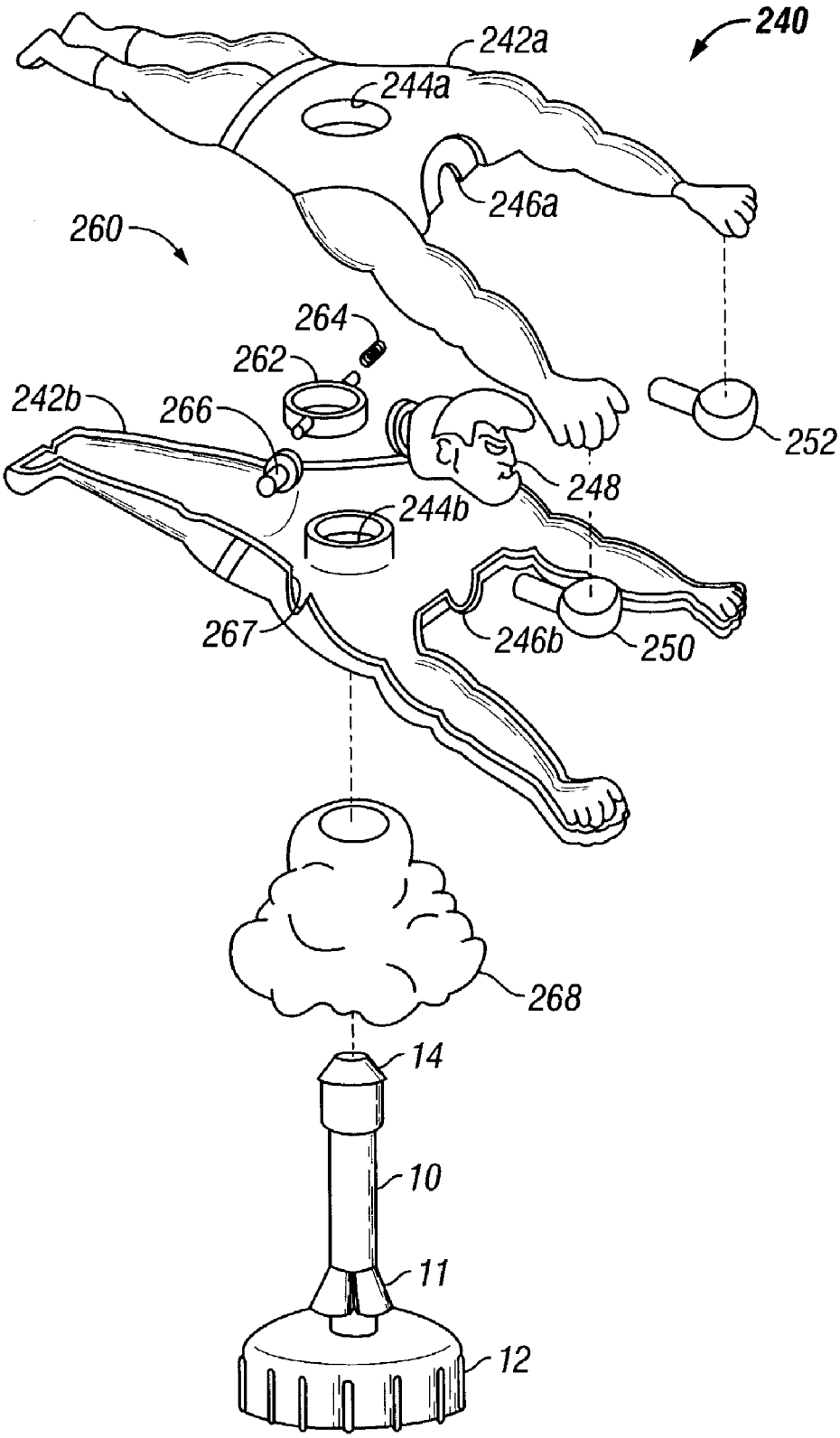
FIGS. 14A–C illustrate an embodiment of an interactive bottle top having a removable body for independent play and for balancing on the stem according to certain teachings of the present disclosure.
Figure 14B:
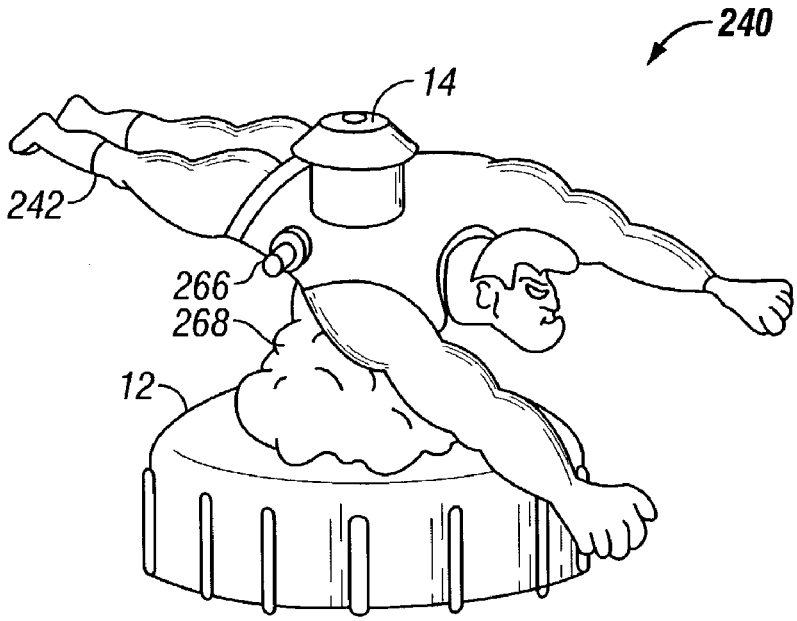
Figure 14C:
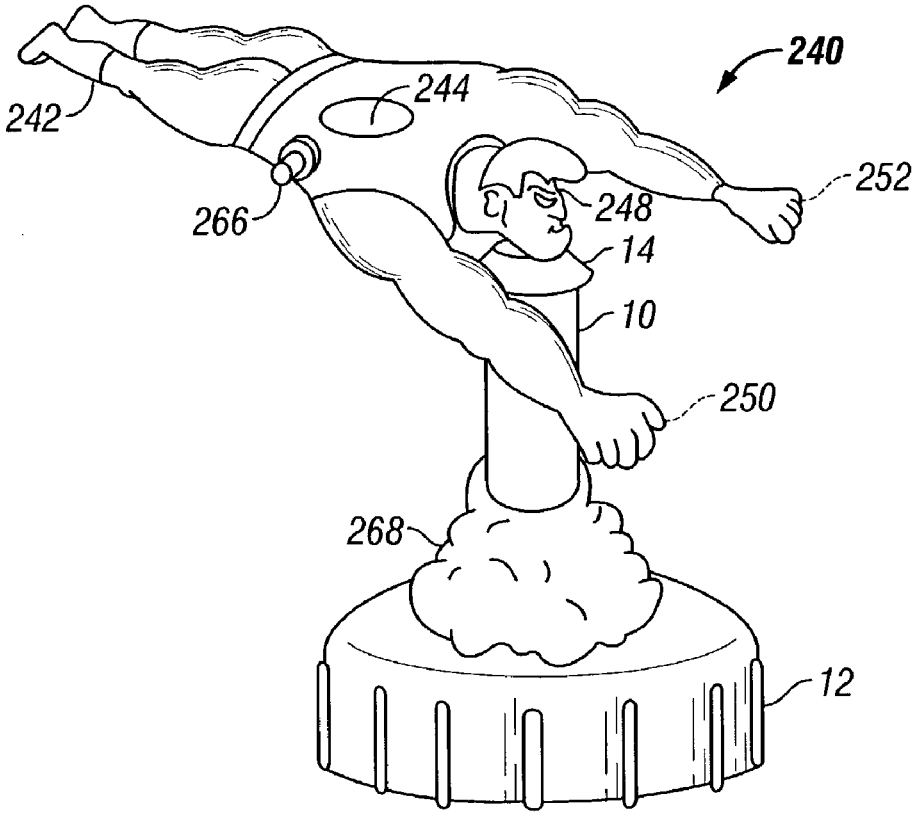

Referring to FIGS. 14A–C, an embodiment of an interactive bottle top 240 having a removable body 241 for independent play and for performing an interactive action of balancing on the stem 10 is illustrated. The bottle top 240 includes the removable body 242, one or more weights 250 and 252, and an optional mounting member 268. The removable body 241 is formed from first and second portions 242*a–b*. Each portion 242*a–b* respectively defines an opening 244*a–b* and a slot 246*a–b*.

A spring loaded attachment device 260 is disposed between the portions 242*a–b* and adjacent the openings 244*a–b*. The attachment device 260 includes a ring-shaped engagement member 262 for engaging a shoulder of the tip 14. The device 260 also includes a biasing spring 264 positioning between the engagement member 262 and the inside of the body 241. A button 266 is disposed through an opening 267 in the body 241 and is used to move the engagement member 262 from outside the body 241. A poseable member or head 248 fits into the slots 246*a–b* and is held therein when the body 241. The one or more weights 250 and 252, which are preferably composed of zinc, position in portions of the body 241 that are distanced from the poseable member 248 and that are distanced from the rest of the body 241.

The mounting member 268 attaches to the stem 10 using techniques disclosed herein. The body 242 is removably attached to the stem 10 using the attachment device 260 held within the body 242 adjacent the opening 244. When the body 242 is removed from the stem 10 as shown in FIG. 14C, the poseable member 248 can be positioned on the tip 14, and the weights 250 and 252 enable the body 241 to be balanced on the tip 14. The poseable member 248 may further include a bottom surface that is shaped substantially complimentary to the tip 14 to further facilitate the interactive operation of balancing on the tip 14.

Figure 15A:
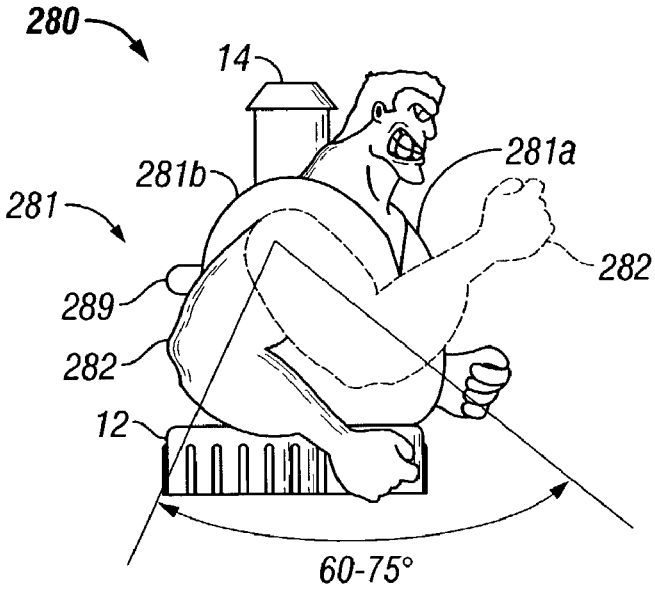
Figure 15B:
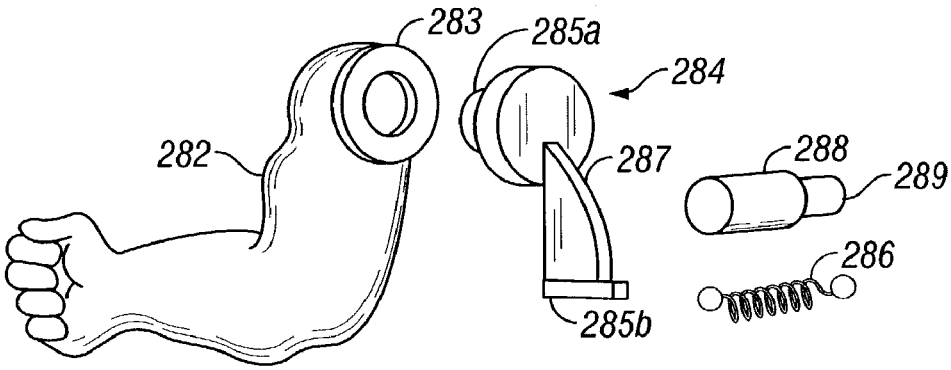
Figure 15C:
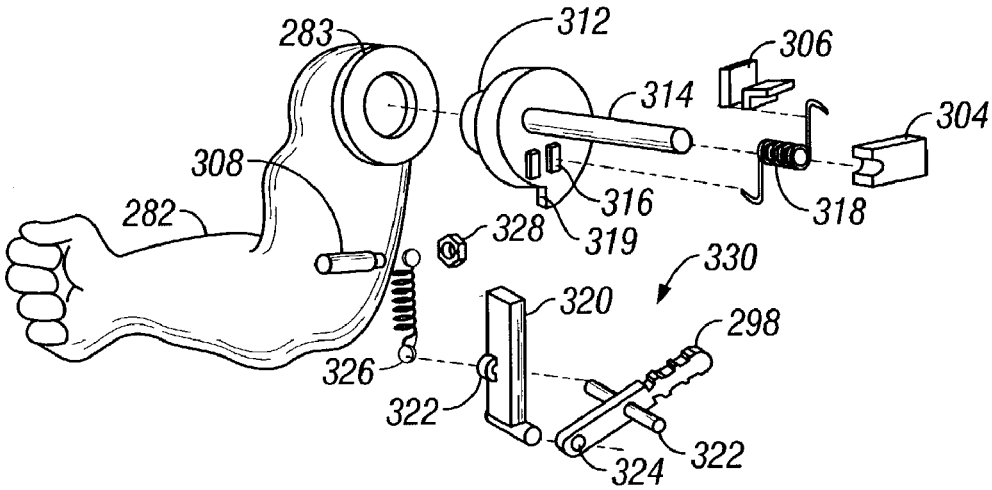

Referring to FIGS. 15A–C, an embodiment of an interactive bottle top 280 having a manually movable member 282 for performing an interactive action is illustrated. The interactive bottle top 280 includes a body 281 that is formed from first and second portions 281*a–b* and that attaches to the stem 10 using techniques disclosed herein. The interactive bottle top 280 also includes a movable member 282 connected to the body 281. One end 283 of the movable member 282 fits into a hole (not visible) in the body 281 and is movable therein.

In an internal arrangement shown in FIG. 15B for operating the interactive action of moving the movable member 282, a lever member 284 is positioned in the body 281 and has one end that connects to the end 283 of the movable member 282. Another end of the lever member 284 connects to a spring 286 that is attached to an inner wall (not shown) of the body 281. A push button 288 is disposed through the wall of the body 281 and engages the lever member 284. By pushing the button 288 from outside the body 281, the lever member 284 can be pivoted against the biasing of the spring 286 and can move the movable member 282. The resistance of the spring 286 returns the movable member 282 and button 288 to a reset position.

In another internal arrangement shown FIG. 15C for operating the interactive action of moving the movable member 282, the one end 283 of the movable member 282 fits into a hole (not visible) in the body 281 and is movable therein. A rotating member 310 is positioned in the body 301 and has one end 312 that connects to the end 303 of the movable member 302. Another end 314 of the rotating member 310 fits onto a support 304 attached to an inner wall (not shown) of the body 301. A torsion spring 318 is disposed on the second end 314 of the rotating member 310. Ribs 306 on the inner wall of the body 301 hold one end of the torsion spring 318, and ribs 316 on the rotating member 310 hold the other end of the torsion spring 318.

A first linkage 320 engages a shoulder 318 on the rotating member 310. The first linkage 320 is biased by a tension spring 326 attached to the inner wall of the body 301 by a pin 308 and nut 328. A second linkage 330 is pivotably connected to the first linkage 320 at 324 and is pivotably connected to the inner wall of the body 301 at 322. Lifting up one end 289 of the second linkage 330 from outside the body 301 disengages the first linkage 320 from the shoulder 319. The torsion spring 318 rotates the rotating member 310 and thereby moves the movable member 302 connected thereto. To permit a user to initiate another movement, the movable member 302 is pulled back to reset the linkages 320 and 330.

Figure 16:
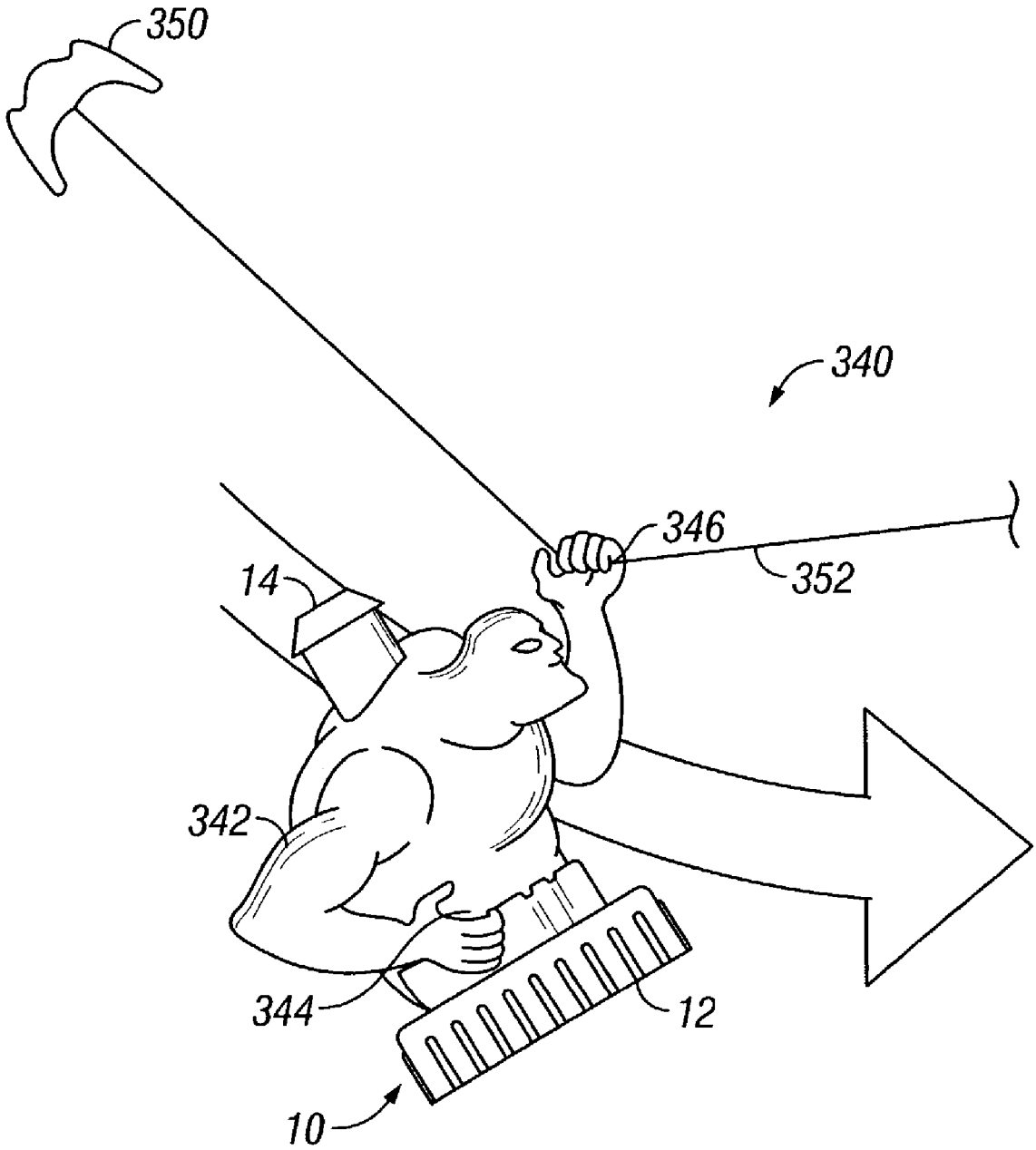
FIGS. 16–19C illustrate embodiments of interactive bottle tops for independent play according to certain teachings of the present disclosure.

Referring to FIG. 16, an embodiment of an interactive bottle top 340 for independent play is illustrated. The bottle top 340 includes a body 342 that can be formed and connected to the stem 10 using techniques disclosed herein. The body 242 defines a slit 344 for temporary storage of an ancillary member 350. The body 242 also defines an open area 346 in which to position a string 352 that is attached to the ancillary member 350. With the string 352 positioned in the open area 346, the top 340 can be slid along the string 352.

Figure 17:
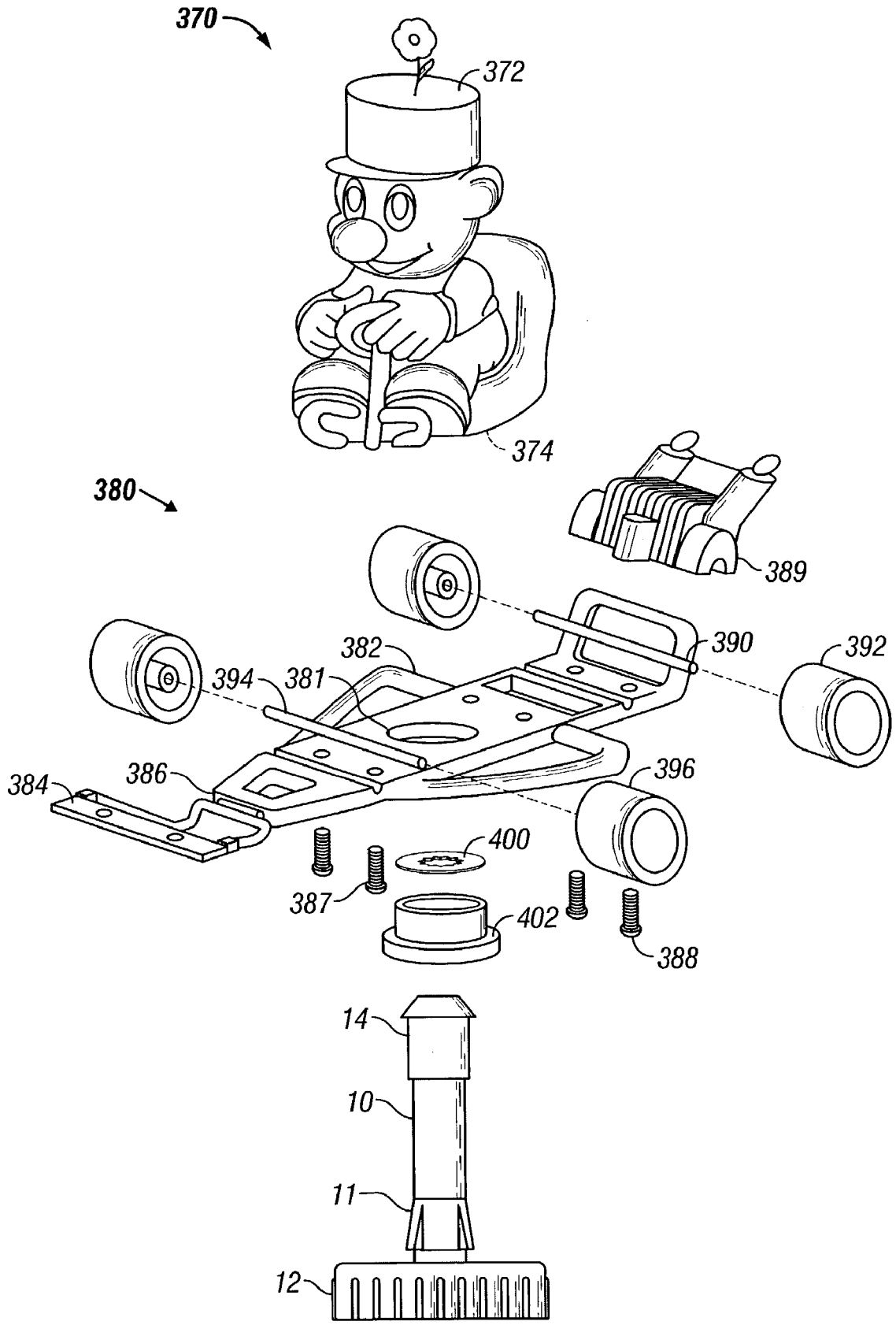

Referring to FIG. 17, an embodiment of an interactive bottle top 370 being removable for independent play is illustrated. The bottle top 370 includes a body 372 and a chassis 380. The body 372 defines an internal passage 374 therethrough and can be a rotocast PVC figurine, for example. The chassis 380 has a first portion 382 and a second portion 384 connected together by a flexible hinge 386. The hinge 386 allows the second portion 384 to be folded over and connected to the second portion 382 by screws 387. A front axle 394 having wheels 396 is trapped in the hinge 386. An ancillary member 389 attaches to the first portion 382 with screws 388 and holds another axle 390 having wheels 392 to the chassis 380. A deformable ring 400 positions below an opening 381 in the chassis. The deformable ring 400 is preferably composed of polyproplyene. Being deformable, the ring 400 fits over and engages the shoulders of retaining members 11 on stem 10 and allows the interactive bottle top 370 to removably mount to the stem 10. The deformable ring 450 in the present embodiment has a serrated opening to facilitate its flexure when removably engaging the retaining members 11 on the stem 10.

To assemble the interactive top, the body 372 is positioned adjacent the hole 382 in the chassis 380. Mounting member 402 surrounds the deformable ring 400, fits into the opening 381, and glues to the body 372 to hold the deformable ring 400 on the chassis 380. To removably attach the chassis 380 to the stem 10, the distal end 14 of the stem 10 is inserted through the mounting member 402 and through the deformable ring 400 in the opening 381 of the chassis 380. The distal end 14 of the stem 10 is further inserted through the internal passage 374 in the body 370 so that the distal end 14 extends from the top of the body 370 for drinking. The deformable ring 400 is pressed past the retaining members 11 on the stem 10, where it engages the shoulders of the retaining members 11 to hold the body/chassis 370/380 to the stem 10. The retaining members 11 are preferably inclined, as shown. Removal can be accomplished by pulling the body/chassis 370/380 off the stem 10 to disengage the deformable ring 400 from the retaining members 11.

Figure 18:
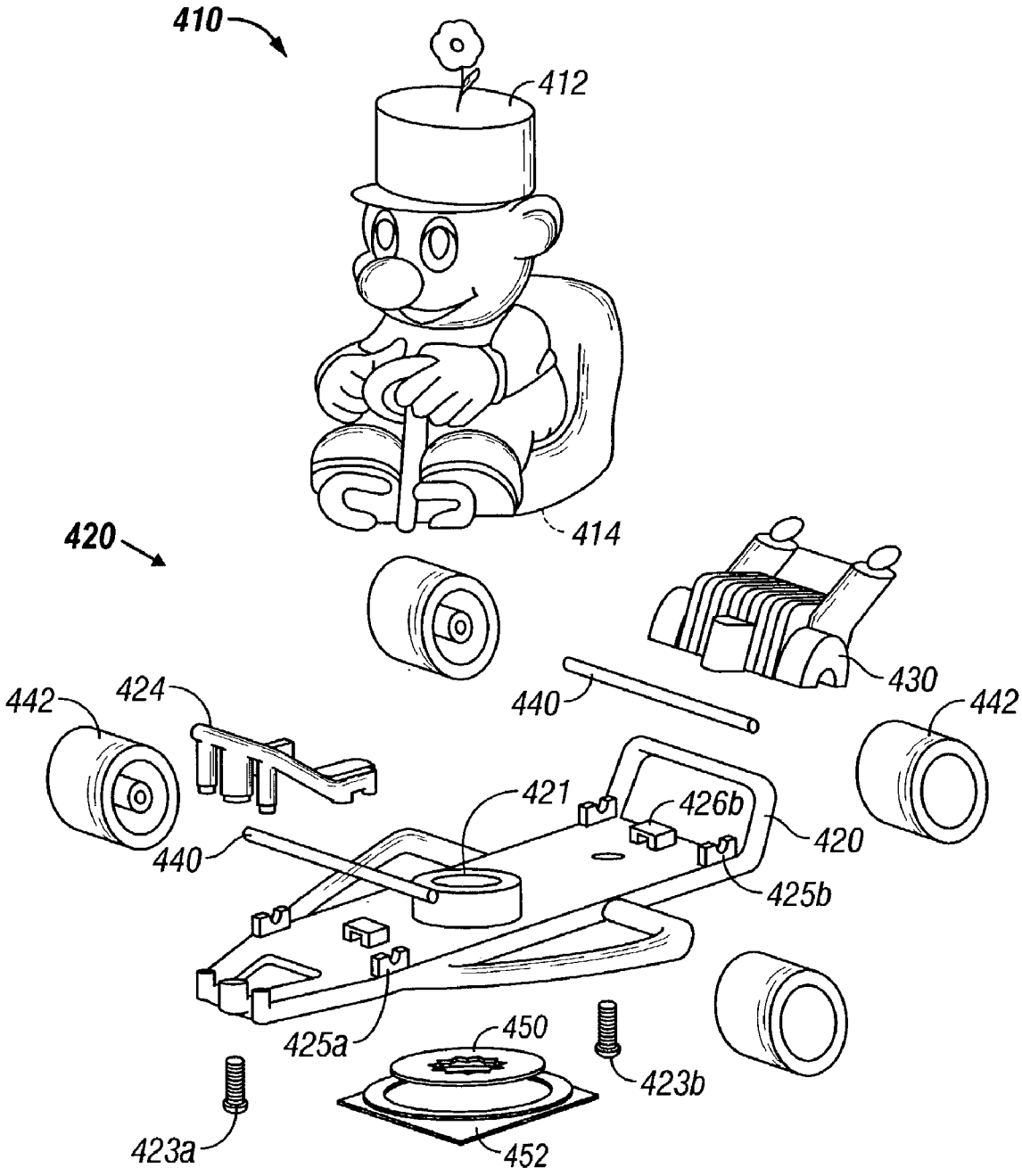
Figure 19A:
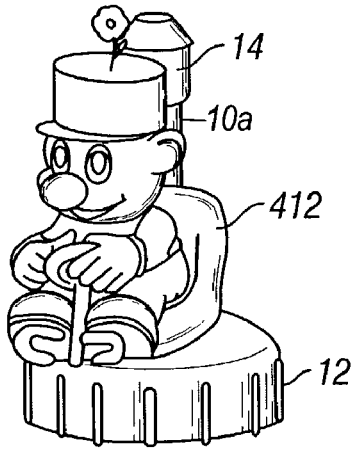

Referring to FIGS. 18 and 19A–C, an embodiment of a modular interactive bottle top 410 being removable for independent play is illustrated. The bottle top 410 includes a removable body 412 and a chassis 420. The body 412 defines an internal passage 414 therethrough and can be a rotocast PVC figurine, for example. As shown in FIG. 19A, the body 412 can be removably attached to a first stem 10A using techniques disclosed herein.

In FIG. 18, the chassis 420 has a first end 422 to which an ancillary member 424 attaches with screws 423*a* and a tab 426*a* to hold an axle 440 and wheels 442 to the chassis 420. Another ancillary member 430 attaches to the other end of the chassis 420 with screws 423*b* and a tab 426*b* to hold another axle 440 having wheels 442 to the chassis 420. A deformable ring 450 preferably composed of polyproplyene positions below an opening 421 in the chassis 420 and allows the chassis 420 to removably mount to a retaining member of a stem (not shown), as discussed above. To assemble, a cover piece 452 attaches to the chassis 420 and traps the deformable ring 450 on the chassis 420.

Figure 19B:
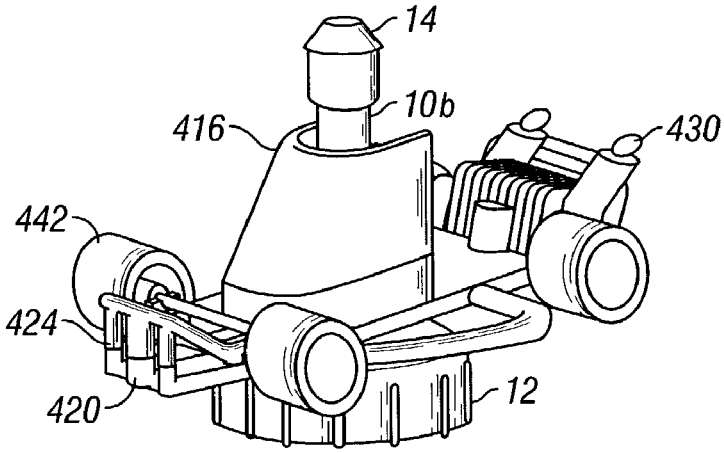
Figure 19C:
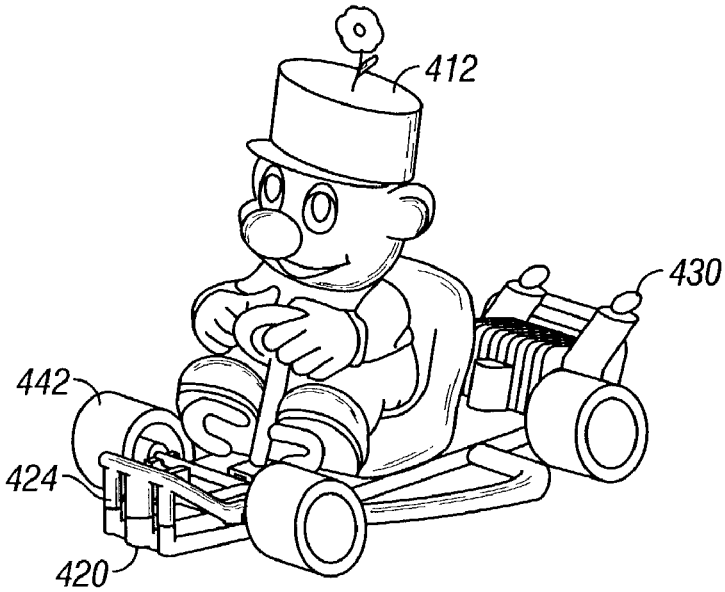

As shown in FIG. 19B, the assembled chassis 420 can removably attach to a second stem 10*b* and can have a temporary, disposable cover 416. As shown in FIG. 19C the chassis 420 and body 410 can be separately removed from their respective stems 10*a* and 10*b* and combined together for active play. As best shown in FIG. 18, the opening 421 in the chassis 420 extends upward from the chassis 420 to mount the removed body 410 on the removed chassis 420. The extended opening 421 can press fit into the lower end of the internal passage 414 in the body 410 to hold the body 410 on the chassis 420. The extended opening 421 can further include a flange or other structure (not shown) to engage the internal passage 414, if desired.

As evidenced by the embodiments disclosed above, one aspect of the disclosed interactive beverage bottle tops can include removable or non-removable bodies on the bottle top. Furthermore, the bodies of the disclosed tops can have various shapes and forms, such as vehicle-shaped bodies (for example, single wheeled, many wheeled, or non-wheeled vehicles) or character-shaped bodies (for example, figurines, animals, vegetables, or minerals).

In another aspect, the disclosed bottle tops can be manually movable or operable. For example, an attached appendage or articulating member can be moved and/or operated mechanically. In another aspect, the disclosed bottle tops can be motorized. For example, the disclosed tops can be operated by a wind-up motor that is activated by an exposed knob that winds up the motor when turned. The knob can be attached to an arm or other appendage, piece of clothing or other attachment of a decorative body of the disclosed top. The wind-up motor can unwind when released or can be set in motion via secondary motion (like waving a magnetic wand near a magnetic sensor or release mechanism. The wind-up motor can perform a number of interactive actions; such as spinning a flywheel up against a sparking material to create sparks on the top. In another example, the disclosed top can include a pullback motor. Pulling back on a portion of the bottle top will wind-up the motor, which can then be released by releasing bottle top or by a button or other motion. In yet another example, the disclosed top can be operated by a flywheel activated by direct revving of the flywheel or by revving with a zip strip. The flywheel can then create interactive motion of articulating a movable member, create sparks, generate current to power lights, or produce sound.

In another aspect, the disclosed bottle tops can be electrically movable or operable. For example, the disclosed tops can be operated by an electric motor that is powered by a battery and is activated by a switch, magnet, light, or sound, for example. The disclosed tops can include lights or speakers on bottle top for performing interactive actions. A switch, a magnetic wand, or motion sensor can activate the lights or speakers, for example. The lights can be LED or Incandescent. The lights or speakers can be battery operated using a button cell or other type of battery, or the lights or speakers can be generator operated. The disclosed bottle tops can also produce interactive sounds when activated by a button, by movement, by waving a magnetic wand, or by liquid moving through spout. The sounds can be electronically produced or can be mechanically produced.

The disclosed interactive beverage bottle tops can be used with water or with a beverage. For example, the disclosed interactive beverage bottle tops can be played with in the water, can float on the water, or can power through the water by wind-up, pull back, flywheel type motor, or battery powered motor. The disclosed tops can be propelled by water using a pressurized pump. The disclosed tops can squirt water. For example: the disclosed bottle top can be loaded full of water and squeezed to squirt water. The disclosed tops can squirt beverage into the mouth of a user by squeezing a trigger or a deformable portion of the top. The disclosed bottle tops can bobble using a spring attached to the stem and to bottle top so that the top bobbles when moved. The disclosed bottle tops can be squeezable such that an interactive action occurs. For example, a gooey substance can be made to ooze from eyes, nose, or mouth of a character as you squeeze it. Squeezing the bottle top can force air to execute a function, such as launching a ball. Squeezing the bottle top can cause liquid to pass through a rotor or an impeller. Gearing can then make an interactive action in the bottle top to occur.

While the disclosed interactive beverage bottle tops have been described with reference to preferred embodiments, obvious modifications and alterations are possible by those skilled in the related art. For example, structures, materials, or acts of one embodiment disclosed herein can be combined with those structures, materials, or acts of another embodiment of the interactive beverage bottle top disclosed herein. The foregoing description of preferred and other embodiments is not intended to limit or restrict the scope or applicability of the inventive concepts that were conceived of by the Applicants. In exchange for disclosing the inventive concepts contained herein, the Applicants desire all patent rights afforded by the appended claims. Therefore, it is intended that the inventive concepts include all modifications and alterations to the full extent that they come within the scope of the following claims or the equivalents thereof.

What is claimed is:

1. A beverage bottle, comprising:

a cap having an attachment end attaching to the bottle and having a stem extending from the attachment end, the stem defining an internal bore and having a distal end for drinking the beverage;

an interactive device on the cap operable to perform an interactive action;

an operating device having a pair of electrical contacts, the pair of electrical contacts attached to the stem and having first ends at least partially positioned in the internal bore;

a fixed housing portion fixedly attached to the stem and at least partially enclosing the pair of electrical contacts; and a removable housing portion housing the interactive device, the removable housing portion removably attaching to the fixed housing portion such that electrical connection is established between the interactive device and second ends of the pair of electrical contacts, wherein the pair of electrical contacts of the operating device at least partially positioned in the internal bore of the stem operate the interactive device in response to beverage being passed through the internal bore of the stem and creating a closed circuit between the pair of electrical contacts.

2. The beverage bottle of claim 1, wherein the interactive device comprises electronics housed in the removable housing portion, the electronics coupling to the electrical contacts and operated by the closed circuit.

3. The beverage bottle of claim 2, wherein the electronics comprise a light, a speaker, a motor, a circuit, or a battery.

4. The beverage bottle of claim 1, wherein the fixed housing portion comprises a receiving member defining a plurality of slots and defining first openings allowing access to the second ends of the pair of electrical contacts.

5. The beverage bottle of claim 4, wherein the removable housing portion comprises a mounting member having a plurality of retainers and defining second openings, the retainers engaging the slots of the receiving member when attached thereto and the second openings allowing access to the second ends of the pair of electrical contacts.

6. The beverage bottle of claim 1, wherein the pair of electrical contacts comprise pins partially inserted into holes defined in a side of the stem, and wherein the fixed housing portion comprises at least two holding members attached around the stem and holding the pins partially inserted in the holes in the stem.

7. The beverage bottle of claim 1, wherein the stem comprises a retaining member adjacent the attachment portion of the cap, and wherein a lower portion of the fixed housing portion is engaged between the retaining member on the stem and the attachment portion to remain fixedly attached to the stem.

8. The beverage bottle of claim 1, wherein the stem comprises a movable spout attached to the distal end of the stem, and wherein an upper portion of the fixed housing portion allows the distal end of the stem with the spout to extend beyond the fixed housing portion.

9. A beverage bottle, comprising:

a top having an attachment end attaching to the bottle and having a stem extending from the attachment end, the stem defining an internal bore and having a distal end for drinking the beverage;

means on the top for performing an interactive action;

means on the top for operating the interactive action in response to the beverage being passed through the internal bore of the stem and creating a closed circuit between electrical contacts;

first means for housing the electrical contacts at least partially positioned in the internal bore of the stem, the first housing means fixedly attached on the stem of the top; and second means for housing the means for performing the interactive action, the second housing means removably attaching to the first housing means and coupling the means for performing the interactive action to the electrical contacts at least partially positioned in the internal bore of the stem.

* * * * *